US011577242B2

(12) United States Patent
Dangla et al.

(10) Patent No.: US 11,577,242 B2
(45) Date of Patent: Feb. 14, 2023

(54) CONTACT-LESS PRIMING METHOD FOR LOADING A SOLUTION IN A MICROFLUIDIC DEVICE AND ASSOCIATED SYSTEM

(71) Applicant: STILLA TECHNOLOGIES, Villejuif (FR)

(72) Inventors: Rémi Dangla, Paris (FR); Étienne Fradet, Arcueil (FR)

(73) Assignee: STILLA TECHNOLOGIES, Villejuif (FR)

( * ) Notice: Subject to any disclaimer, the term of this patent is extended or adjusted under 35 U.S.C. 154(b) by 473 days.

(21) Appl. No.: 16/859,460

(22) Filed: Apr. 27, 2020

(65) Prior Publication Data

US 2020/0316587 A1 Oct. 8, 2020

Related U.S. Application Data

(63) Continuation of application No. 15/568,399, filed as application No. PCT/EP2016/059034 on Apr. 22, 2016, now Pat. No. 10,632,465.

(30) Foreign Application Priority Data

Apr. 22, 2015 (EP) ..... 15164723

(51) Int. Cl.
*B01L 3/00* (2006.01)

(52) U.S. Cl.
CPC ..... *B01L 3/50273* (2013.01); *B01L 3/502715* (2013.01); *B01L 2200/027* (2013.01); *B01L 2200/0642* (2013.01); *B01L 2300/042* (2013.01); *B01L 2300/049* (2013.01); *B01L 2300/0809* (2013.01); *B01L 2300/0877* (2013.01); *B01L 2300/14* (2013.01); *B01L 2400/0487* (2013.01); *B01L 2400/0605* (2013.01)

(58) Field of Classification Search
CPC ..... B01L 3/50273; B01L 2400/0605; B01L 2400/0487; B01L 2300/14; B01L 2300/0877; B01L 2300/0809; B01L 2300/049; B01L 2300/042; B01L 2200/0642; B01L 2200/027; B01L 3/502715
See application file for complete search history.

(56) References Cited

U.S. PATENT DOCUMENTS

| | | | |
|---|---|---|---|
| 5,904,933 | A | 5/1999 | Riess et al. |
| 6,281,254 | B1 | 8/2001 | Nakajima et al. |
| 6,756,019 | B1 | 6/2004 | Dubrow et al. |
| 7,129,091 | B2 | 10/2006 | Ismagilov et al. |
| 2002/0058332 | A1 | 5/2002 | Quake et al. |
| 2006/0163070 | A1 | 7/2006 | Boronkay et al. |
| 2009/0053719 | A1 | 2/2009 | Lo et al. |
| 2012/0236312 | A1 | 9/2012 | Takashimizu |
| 2013/0037115 | A1 | 2/2013 | Beebe et al. |
| 2013/0040406 | A1 | 2/2013 | Rostaing et al. |
| 2014/0378348 | A1 | 12/2014 | Makarewicz, Jr. et al. |

FOREIGN PATENT DOCUMENTS

| | | |
|---|---|---|
| EP | 2672273 | 12/2013 |
| JP | 2001145486 | 5/2001 |
| JP | 2003153692 | 5/2003 |
| WO | 2006062805 | 6/2006 |
| WO | 2009015296 | 1/2009 |
| WO | 2013159117 | 10/2013 |
| WO | 2014056930 | 4/2014 |
| WO | 2014205447 | 12/2014 |

OTHER PUBLICATIONS

Beer et al., On-Chip, Real-Time, Single Copy Polymerase Chain Reaction in Picoliter Droplets Anal. Chem. 2007, 79, 8471-8475—Nov. 15, 2007.
Beer et al., On-Chip Single-Copy Real-Time Reverse-Transcription PCR in Isolated Picoliter Droplets Anal. Chem. 2008, 80, 1854-1858—Mar. 15, 2008.
Curcio et al., Continuous Segmented-Flow Polymerase Chain Reaction for High-Throughput Miniaturized DNA Amplification Anal. Chem. 2003, 75, 1-7—Jan. 1, 2003.
Fan et al., Microfluidic digital PCR enables rapid prenatal diagnosis of fetal aneuploidy American Journal of Obstetrics & Gynecology, 543.e1-543.e7, May 2009.
Fluidigm BioMark System, including the Fluidigm 12.765 Digital Array Retrieved from Internet—May 14, 2008.
Katsura et al., PCR Amplification of a Single DNA Molecule Bio Industry 2002, vol. 19, No. 8, 36-42—Aug. 2002.
Kiss et al., High-Throughput Quantitative Polymerase Chain Reaction in Picoliter Droplets Anal. Chem. 2008, 80, 8975-8981—Dec. 1, 2008.
Klein et al., Accurate estimation of transduction efficiency necessitates a multiplex real-time PCR Gene Therapy (2000) 7,458-463—2000.
Kopp et al., Chemical Amplification: Continuous-Flow PCR on a Chip. Science 280 (5366), 1046-1048—May 15, 1998.
Krafft et al., Emulsions and microemulsions with a fluorocarbon phase Current Opinion in Colloid and Interface Science 8 (2003) 251-258—2003.
Nakano et al., Development of Amplification of Unknown DNA Fragment and Single-Molecule PCR Proceedings of the Annual Meeting of The Institute of Electrostatics Japan '01 (Sep. 2001) 141 144—Sep. 2001.
Nisisako et al., Droplet formation in a microchannel network Lab Chip, 2002, 2, 24-26—Jan. 18, 2002.

(Continued)

*Primary Examiner* — Christopher Adam Hixson
(74) *Attorney, Agent, or Firm* — Morrison & Foerster LLP

(57) ABSTRACT

The present invention relates to a contact-less priming system for loading a solution in a microfluidic device comprising: at least one microfluidic device, a pressure chamber configured to enclose said at least one microfluidic device, a pressurization unit fluidly connected to the pressure chamber and at least one closing member. The present invention also relates to a contact-less priming method for loading a solution in a microfluidic device.

15 Claims, 12 Drawing Sheets

(56) References Cited

OTHER PUBLICATIONS

Nakano et al., Single-molecule PCR using water-in-oil emulsion Journal of Biotechnology 102 (2003) 117-124—2003.
Raindance RDT 1000 System Retrieved from Internet—Nov. 5, 2008.
Riess et al., Fluorous micro- and nanophases with a biomedical perspective Tetrahedron 58 (2002) 4113-4131—2002.
Sadtler et al., Achieving Stable, Reverse Water-in-Fluorocarbon Emulsions Angew. Chem. Int. Ed. Engl. 1996, 35, No. 17, 1976-1978—1996.
Song et al., A Microfluidic System for Controlling Reaction Networks in Time Angew. Chem. Int. Ed. 42, No. 7, 767-772—2003.
Sugiura et al. Interfacial Tension Driven Monodispersed Droplet Formation from Microfabricated Channel Array Langmuir 2001, 17, 5562-5566—May 23, 2001.
Thorsen et al., Dynamic Pattern Formation in a Vesicle-Generating Microfluidic Device Physical Review Letters, vol. 86, No. 18, 4163-4166—Apr. 30, 2001.
Vogelstein et al., Digital PCR Proc. Natl. Acad. Sci. USA., vol. 96 (1999), 9236-9241—Aug. 1999.
Wittwer et al., Real-Time Multiplex PCR Assays Methods 25, 430-442—2001.
Yung et al., Single-Molecule Detection of Epidermal Growth Factor Receptor Mutations in Plasma by Microfluidics Digital PCR in Non-Small Cell Lung Cancer Patients Clin. Cancer Res. 2009; 15(6) Mar. 15, 2009; 2076-84—Mar. 15, 2009.
Zeng et al., High-Performance Single Cell Genetic Analysis Using Microfluidic Emulsion Generator Arrays Anal. Chem. 2010, 82, 3183-3190—Mar. 1, 2010.
Juncker et al., "Autonomous Microfluidic Capillary System," Analytical Chemistry, vol. 74, No. 24, pp. 6139-6144, Dec. 15, 2002.
Ducree et al., "The centrifugal microfluidic Bio-Disk platform," Journal of Micromechanics and Microengineering, vol. 17, pp. S103-S115, Jun. 28, 2007.
International Search Report, dated Jun. 30, 2016 from corresponding PCT application No. PCT/EP2016/059034.
European Search Report, dated Oct. 7, 2015 from corresponding EP application No. 15164723.7.
Sugiura et al., "Interfacial Tension Driven Monodispersed Droplet Formation from Microfabricated Channel Array", Langmuir 2001, vol. 17, No. 18, pp. 5562-5566, May 23, 2001.

CONTACT-LESS PRIMING METHOD FOR LOADING A SOLUTION IN A MICROFLUIDIC DEVICE AND ASSOCIATED SYSTEM

FIELD OF INVENTION

The present invention relates to a method for priming a solution in a microfluidic device. In particular, the present invention relates to a method for contact-less priming a solution in a microfluidic device by means of a pressure chamber. The invention also relates to a system for implementing said method.

BACKGROUND OF INVENTION

Microfluidic devices are used in an increasing number of applications: pharmacology, cell biology, genetics and biochemistry such as for instance for implementing polymerase chain reaction (frequently referred to as "PCR"). Microfluidic technologies enable the control and manipulation of fluids at a very small scale thereby reducing the cost of equipment and the volume of solution required.

It is known from WO 2014/056930, in the name of the applicant, to use droplet-based microfluidics for treating and analyzing a solution containing a biological material by (i) introducing said solution into microchannels of a microfluidic circuit; (ii) detaching drops of said solution in a carrier fluid, caused by the divergence of the microchannel walls, coupled with the effects of the surface tension of said solution; (iii) moving at least a portion of said drops in said carrier fluid to at least one drop storage zone in said microfluidic circuit caused by the divergence of said microchannel walls, coupled with the effects of the surface tension of said drops; (iv) applying a treatment to said drops situated in said storage zone(s); and (v) analyzing said drops situated in the storage zone(s).

One important issue for the development of microfluidic devices, such as that described in WO 2014/056930, is that sample introduction in the microfluidic device must be carried out in a reliable, accurate and convenient manner.

WO 2014/056930 describes introduction of a solution by adjusting the end of a pipette or the needle of a syringe in a supply hole before discharging the solution by pressing on the syringe or pipette.

US 2006/0163070 describes an apparatus for priming microfluidic device. Said apparatus comprises a carrier, having at least one reservoir, configured to receive a microfluidic circuit, wherein the reservoir is in fluid communication with the microfluidic circuit; and a priming unit comprising pressure applying means for applying pressure on the reservoir. Said pressure applying means comprises an outlet with an interface for contact with said reservoir.

Thus, the supply of samples in microfluidic devices commonly use pressure-driven pumping methods and requires an inlet port fluidly connected, by means of tubing, to actuators such as a syringe pump, a flow controller or a peristaltic pump. Said loading processes exhibits many drawbacks as they require (i) the knowledge of the precise location of the inlet port(s), (ii) one actuator and at least one connector for each inlet port and (iii) a complex assembly. Also, fluidic connections of the prior art increase the risk of cross-contamination between successive samples since connectors and samples are in contact or close proximity during priming of the microfluidic circuit.

Some contact-less loading methods have already been disclosed in the prior art to load the microfluidic circuit such as capillary action (Juncker D; et al., Autonomous microfluidic capillary system, Anal. Chem., 74 (2002), 6139-6144) or centrifugation (Ducrée J. et al.; The centrifugal microfluidic Bio-Disk platform, J. Micromech. Microeng. 17 (2007) S103-S115). However, said processes need to be optimized according to the physical properties of each fluid used (density, viscosity, surface tension) and cannot be used for two phase flows such as droplet formation.

It is therefore an object of the present invention to provide a universal contact less priming method for loading a solution inside a microfluidic device. Said contactless method may be carried out in a very simple manner by any operator, enables loading multiple devices with multiple fluids and thereby parallelization of the loading process (i.e. loading simultaneously at least two devices) and also avoids contamination due to the lack of physical connection.

SUMMARY

To these ends, the invention provides a contact-less priming system for loading a solution in a microfluidic device comprising:

- at least one microfluidic device comprising at least one first port, at least one second port and at least one microchannel, wherein each of said at least one first and second ports are fluidly connected to said at least one microchannel and wherein said at least one first port is suitable for containing at least one solution;
- a pressure chamber with at least one closable, gas tight aperture, configured to enclose said at least one microfluidic device;
- a pressurization unit fluidly connected to the pressure chamber for applying pressure in the pressure chamber and upon the at least one first port and at least one second port; and
- at least one closing member configured to close at least partially and/or to open at least partially a port, wherein said at least one closing member is disposed on the at least one first port or the at least one second port.

According to one embodiment, the at least one first port has a capacity ranging from 1 to 1000 microliters.

According to one embodiment, the pressurization unit comprises a pressure source, a pressure monitoring device and a feedback control to pressurize the pressure chamber at a pressure suitable to cause a selected amount of the at least one solution to pass from the at least one first port to the at least one microchannel.

According to one embodiment, the at least one closing member is selected from at least one stopper, at least one flow restrictor or at least one check-valve.

According to one embodiment, the contact-less priming system according to the invention further comprises at least another closing member, such that a closing member is disposed on each of the at least one first and second ports. According to one embodiment, the at least another closing member is selected from at least one stopper, at least one flow restrictor or at least one check-valve.

According to one embodiment, the contact-less priming system according to the invention further comprises at least one filter disposed on the at least one first port and/or on the at least one second port inhibiting liquid flow and permeable to gas.

According to one embodiment, the at least one second port is suitable for containing at least one solution and has a capacity ranging from 1 to 1000 microliters.

According to one embodiment, the at least one of microchannel comprises at least one network of microchannels.

According to one embodiment, the at least one network of microchannels comprises at least one microchannel and one fluid partitioning zone.

According to one embodiment, the at least one network of microchannels further comprises at least one region for trapping at least one dispersed phase.

The invention also provides a contact-less priming method for loading a solution in a microfluidic device; said method comprising the following step:

providing at least one microfluidic device comprising at least one first port, at least one second port and at least one microchannel, wherein each of said at least one first and second ports are fluidly connected to said at least one microchannel and wherein the at least one first port is suitable for containing at least one solution;

loading at least one solution in the at least one first port;

providing at least one closing member configured to close at least partially and/or to open at least partially a port, wherein said at least one closing member is disposed on the at least the first port or the at least one second port;

introducing and enclosing said at least one microfluidic device with the at least one solution and the at least one closing member in a pressure chamber through at least one closable, gas tight aperture of said pressure chamber under atmospheric pressure; and pressurizing the pressure chamber.

According to one embodiment, the contact-less priming method according to the invention further comprises the step of loading at least one solution in the at least one second port.

According to one embodiment, the contact-less priming method according to the invention further comprises the step of returning pressure within the pressure chamber to atmospheric pressure without back flow of the at least one solution from the at least one microchannel to the at least one first port.

Definitions

In the present invention, the following terms have the following meanings:

"Closing member" refers to any structure specifically adapted to limit, inhibit or prevent the flow of fluid through a fluid path or between fluid paths, reservoirs, and the like in at least one direction, thereby limiting, inhibiting or preventing the transmission of a pressure difference through a fluid path or between fluid paths, reservoirs, and the like in at least one direction. The closing member according to the invention may be constructed to function as a valve, such as for instance a check-valve or a flap (inhibiting or preventing the flow of fluid in a single direction of a fluid path), as a stopper (inhibiting or preventing the flow of fluid in the two directions of a fluid path) or as a fluid restrictor (limiting the flow of fluid in the two directions of a fluid path).

"Enclosed" means enclosed on all sides or surrounded. Within the present invention, the microfluidic device is fully inside the pressure chamber and fully surrounded by the walls of the pressure chamber.

"Microfluidic device" refers to a device or circuit comprising at least one microchannel having a cross-sectional dimension of less than 1 millimeter. Within the present invention the microfluidic device may be a microfluidic chip.

"Pressurization unit" refers to a unit comprising at least a pressure source which may be operated in positive or negative pressure (in this latter embodiment, the pressure source is also referred to as a "vacuum source").

DETAILED DESCRIPTION

The following detailed description will be better understood when read in conjunction with the drawings. For the purpose of illustrating, the device is shown in the preferred embodiments. It should be understood, however that the application is not limited to the precise arrangements, structures, features, embodiments, and aspect shown. Certain terminology is used in the following description for convenience only and is not limiting. The drawings are not drawn to scale and are not intended to limit the scope of the claims to the embodiments depicted.

The invention relates to a contact-less priming system for loading a solution in a microfluidic device comprising:

at least one microfluidic device comprising at least one microchannel, said at least one microfluidic device having at least one first port and at least one second port; wherein each of said at least one first and second ports are fluidly connected to said at least one microchannel and wherein said at least one first port is suitable for containing at least one solution;

a pressure chamber with at least one closable, gas tight aperture, configured to enclose said at least one microfluidic device;

a pressurization unit fluidly connected to the pressure chamber for applying pressure in the pressure chamber and upon the at least one first port and at least one second port; and at least one closing member configured to close at least partially and/or to open at least partially a port, wherein said at least one closing member is disposed on the at least one first port or the at least one second port.

According to one embodiment, said at least one closing member is configured to close and/or to open a port.

According to one embodiment, said at least one closing member is disposed on the at least one first port or the at least one second port so that the pressure applied in the pressure chamber is transmitted into said port with closing member in a different manner than it is transmitted into the other port, resulting in a pressure difference between the at least one first port and the at least second port suitable for generating a flow of the at least one solution from the at least one first port to the at least one second port through the at least one microchannel.

According to one embodiment, the pressure exerted upon the at least one microfluidic device and the at least one closing member exerts a non-uniform pressure between the at least one first port and the at least second port suitable for generating a flow of the at least one solution from the at least one first port to the at least one microchannel.

According to one embodiment, the closing member is configured such that when a pressure is exerted upon the at least one microfluidic device, said pressure is transmitted non-uniformly between the at least one first port and the at least second port; thereby generating a flow of the at least one solution from the at least one first port to the at least one microchannel.

According to one embodiment, the at least one microfluidic device is constructed from glass or other rigid material known from one skilled in the art such as for instance silicon or borosilicate glass. According to an alternative embodiment, the at least one microfluidic device is constructed from a polymer, preferably a rigid polymer, such as for instance polydimethylsiloxane ("PDMS"), poly(methyl methacrylate) ("PMMA"), cyclo-olefin polymer ("COP"), cyclo-olefin copolymer ("COC") or polycarbonate ("PC").

According to one embodiment, the at least one closing member is constructed from a polymer, such as for instance polydimethylsiloxane ("PDMS"), poly(methyl methacrylate) ("PMMA"), cyclo-olefin polymer ("COP"), cyclo-olefin copolymer ("COC") or polycarbonate ("PC").

According to one embodiment, the at least one microchannel comprises a network of microchannels.

According to one embodiment, the at least one first port has a capacity ranging from 1 to 1000 microliters, from 1 to 500 microliters, from 5 to 200 microliters or from 20 to 100 microliters.

According to one embodiment, the at least one first port is a cylindrical well extending outwards from the surface of the microfluidic device. According to one embodiment, the outer wall of said well has the dimensions of the standardized male Luer taper. According to another embodiment, the inner wall of said well has the dimensions of the standardized female Luer taper. According to another embodiment, the outer wall of said well has the dimensions of the standardized male mini-Luer taper. According to another embodiment, the inner wall of said well has the dimensions of the standardized female mini-Luer taper.

According to one embodiment, the at least one second port is suitable for containing at least one solution. According to one embodiment, the at least one second port has a capacity ranging from 1 to 1000 microliters, from 1 to 500 microliters, from 5 to 200 microliters or from 20 to 100 microliters.

According to one embodiment, the at least one second port is a cylindrical well extending outwards from the surface of the microfluidic device. According to one embodiment, the outer wall of said well has the dimensions of the standardized male Luer taper. According to another embodiment, the inner wall of said well has the dimensions of the standardized female Luer taper. According to another embodiment, the outer wall of said well has the dimensions of the standardized male mini-Luer taper. According to another embodiment, the inner wall of said well has the dimensions of the standardized female mini-Luer taper.

According to one embodiment, the pressure chamber is a chamber or box with at least one closable, gas tight aperture of dimensions suitable for introducing the at least one microfluidic device. According to one embodiment, the inner volume of the pressure chamber ranges between 500 mL and 2 L, preferably between 100 mL and 5 L.

According to one embodiment, the pressure chamber is a chamber adapted for containing at least one microfluidic device according to the invention, preferably 1, 2, 3, 4, 5, 6, 7, 8, 9, 10, 15, 20, 25 microfluidic devices.

According to one embodiment, the pressure chamber comprises at least one bottom plate wherein the at least one microfluidic device is disposed. According to one embodiment, the pressure chamber comprises at least one carrier wherein the at least one microfluidic device is disposed.

According to one embodiment, the dimensions of the pressure chamber are such that neither said at least one first and second ports, nor said at least one closing member are in direct physical contact with surfaces of the pressure chamber when said at least one microfluidic device is disposed into the pressure chamber.

According to one embodiment, there are no contact surface between the ports and the pressure chamber. Thus, when the pressure chamber is pressurized by a pressurization unit, a generally uniform pressure is exerted on the microfluidic device and especially on the at least one first port and the at least one second port. According to one embodiment, the microfluidic device is placed on the bottom of the pressure chamber and the only contact surface between the microfluidic device and the pressure chamber is between the bottom surface of the pressure chamber and the bottom surface of the microfluidic device.

According to one embodiment, as depicted in FIG. 21, the pressure chamber 1 comprises a movable top lid 15 including a gasket 16 placed between the movable lid and walls of the pressure chamber to close the aperture 17 and seal the pressure chamber such that the chamber remains gas tight when subject to an inner vacuum. According to another embodiment, the pressure chamber further comprises a clamping mechanism 18 to press the movable top lid onto the gasket and walls of the pressure chamber, closing the aperture 17 and sealing the pressure chamber at force such that the chamber remains leak tight when subject to an inner overpressure of at most 1 mbar, preferentially at most 2 bar.

When the movable top lid 15 is in the open position, as depicted in FIG. 21A, the aperture 17 is sufficiently large to introduce said at least one microfluidic device 2 into the pressure chamber 1 and dispose it onto said at least one bottom plate 19 or at least one carrier. The dimensions of the pressure chamber and the position of said at least one bottom plate or at least one carrier are such that, when the top lid is in the closed position as depicted in FIG. 21B, said at least one first and second ports 3, 4 of said at least one microfluidic device, as well as said at least one stopper 6 disposed onto said at least one first or second ports, are not in direct contact with neither the bottom, side and top surfaces of said at least one pressure chamber.

According to one embodiment, the pressure chamber comprises at least one transparent window.

According to one embodiment, the pressure chamber comprises at least one fluidic port connecting the inner volume of the pressure chamber to an external fluidic environment through a hole in one of the walls of the pressure chamber.

According to one embodiment, the pressurization unit comprises a pressure source connected to the pressure chamber via tubing and the at least one fluidic port of the pressure chamber to pressurize the pressure chamber at a pressure suitable to cause a selected amount of the at least one solution to flow from the at least one first or second port to the at least one microchannel.

According to one embodiment, the pressurization unit is connected to the pressure chamber on a top or a lateral surface of the pressure chamber. According to one embodiment, the pressurization unit is not connected to the pressure chamber on its bottom plate.

According to one embodiment, the pressurization unit further comprises a pressure regulator to set the inner pressure of the pressure chamber to a desired value.

According to one embodiment, the pressure chamber comprises at least one second fluidic port and the pressurization unit further comprises at least one pressure monitoring device, for example a manometer, connected to the pressure chamber via said at least one second fluidic port of the pressure chamber to monitor the inner pressure of the pressure chamber in real-time.

According to one embodiment, the pressurization unit comprises a pressure source, a controllable pressure regulator, a pressure monitoring device and a closed-loop feedback control system between the pressure monitoring device and the pressure regulator in order to precisely control the inner pressure of the pressure chamber in real-time in order to control the flow of the at least one solution from the at least one first or second port to the at least one network of microchannels.

According to one embodiment, the pressurization unit operates in positive pressure, subjecting the inner volume of the pressure chamber to an overpressure. According to one embodiment, the pressurization unit operates in negative pressure, subjecting the inner volume of the pressure chamber to a vacuum. According to one embodiment, the pressurization unit operates both in positive and negative pressures.

According to one embodiment, said bottom plate of said pressure chamber further comprises a controllable heating element, such as a heating resistor or a Peltier element. According to one embodiment, said heating element is placed under said bottom plate.

According to one embodiment, said bottom plate of said pressure chamber is in direct contact with the flat plate thermal block of a thermal cycler, said thermal cycler being used as a temperature controller for said bottom plate.

According to one embodiment, said heating element allows to set the temperature of the plate to any desired temperature ranging from 0° C. to 100° C., or from −20° C. to 150° C.

According to one embodiment, the at least one closing member is selected from at least one stopper, at least one flow restrictor or at least one check-valve.

According to one embodiment, the at least one stopper is a gas impermeable cap to be placed on top of one of said first and second ports of said microfluidic device.

According to another embodiment, the at least one stopper is a gas impermeable plug to be placed into one of said first and second ports of said microfluidic device. According to another embodiment, the at least one stopper is a gas impermeable sealing film, such as an adhesive PCR sealing film.

According to one embodiment, the at least one flow restrictor is a diaphragm including at least one opening, said at least one opening may be constructed in any manner that allows the passage of fluid through the at least one opening. For example, opening may be constructed in a variety of shapes: square, rectangular, polygon or circle. According to an alternative embodiment, the flow restrictor is a gas permeable membrane, such as a sheet of (poly)dimethylsiloxane or an adhesive gas permeable microtiter plate seal.

According to one embodiment the at least one check-valve is disposed onto the first or second port as an inward check-valve, allowing fluid to flow from the outside of the microfluidic device to the at least one microchannel of the microfluidic device via said first or second port.

According to one embodiment, the at least one inward check-valve is a diaphragm check-valve. According to another embodiment, the at least one inward check-valve is a duckbill check-valve, or a spring-loaded check-valve.

According to one embodiment the at least one check-valve is disposed onto the first or second port as an outward check-valve, allowing fluid to flow from the at least one microchannel to the outside of the microfluidic device via the first or second port.

According to one embodiment, the at least one outward check-valve is a diaphragm check-valve. According to another embodiment, the at least one outward check-valve is a duckbill check-valve, or a spring-loaded check-valve.

According to one embodiment, the at least one outward check-valve is a flap to be disposed on top of said first or second port of said microfluidic device. According to one embodiment, said flap is a partially sealed film placed on top of said first or second port of said microfluidic device. According to another embodiment, said flap is a thin sheet of polymer such as rubber or silicone disposed on top of said first or second port of said microfluidic device.

According to one embodiment, the at least one outward check-valve is a plastic or metal ball disposed into said first or second port of said microfluidic device.

According to one embodiment, the at least one closing member has a standardized Luer fitting geometry complementary to the Luer geometry of the first or second port in order to be firmly and reproducibly disposed onto said port. According to another embodiment, the at least one closing member has a standardized mini-Luer geometry complementary to the mini-Luer geometry of the first or second port in order to be firmly and reproducibly disposed onto said port.

According to one embodiment, the contact-less priming system further comprises at least another closing member, such that a closing member is disposed on each of the at least one first and second ports.

According to one embodiment, the at least another closing member is selected from at least one stopper, at least one flow restrictor or at least one check-valve disposed as an inward check-valve or outward check-valve.

According to one embodiment, the at least another closing member has a standardized Luer fitting geometry complementary to the Luer geometry of the first or second port in order to be firmly and reproducibly disposed onto said first or second port. According to another embodiment, the at least one closing member has a standardized mini-Luer geometry complementary to the mini-Luer geometry of the first or second port in order to be firmly and reproducibly disposed onto said first or second port.

According to one embodiment, the at least one closing member and the at least another closing member are neither two stoppers, neither two outward check-valves, neither two inward check-valves nor two flow restrictors.

According to one embodiment, when the pressurization unit operates in positive pressure, the at least one closing member and the at least one another closing member are not one stopper and one outward check-valve.

According to one embodiment, when the pressurization unit operates in negative pressure, the at least one closing member and the at least one another closing member are not one stopper and one inward check-valve.

According to one embodiment, the contact-less priming system according to the invention further comprises at least one filter disposed on the at least one first port and/or the at least one second port. Said filter is permeable to gas while inhibiting liquid flow. Said filter also prevents cross-contamination.

According to one embodiment, the at least one microchannel is straight. According to one embodiment, the at least one microchannel is curved or angulated. According to one embodiment, the at least one microchannel is fluidly connected to at least one first port and at least one second port; each being located on the upper surface of the microfluidic device.

According to one embodiment, the at least one microchannel has a rectangular transverse cross-section. According to one embodiment, at least one of the microchannels of the network of microchannels has a rectangular transverse cross-section. According to one embodiment, the width of the at least one microchannel is between 5 μm and 500 μm, or between 1 μm and 1 mm. According to one embodiment, the height of the at least one microchannel is between 5 μm and 200 μm, or between 1 μm and 1 mm.

According to one embodiment, the at least one network of microchannels comprises at least one microchannel and at least one microchamber between the at least one first port and the at least one second port. According to one embodiment, the at least one microchamber has a width that is at least 5 times the width of the at least one microchannel that leads to it.

According to one embodiment, the at least one network of microchannels comprises at least one fluid partitioning zone between the at least one first port and the at least one second port, said fluid partitioning zone being used for forming fluid partitions such as bubbles or droplets of at least one dispersed phase into an immiscible carrier fluid.

According to one embodiment, the immiscible carrier fluid is oil, such as mineral oil, silicone oil or fluorinated oil, and said at least one dispersed phase is an aqueous solution or gaseous mixture.

According to one embodiment, the immiscible carrier fluid is an aqueous solution and the said at least one dispersed phase is oil, such as mineral oil, silicone oil or fluorinated oil, or a gaseous mixture.

According to one embodiment, the immiscible carrier fluid contains a surfactant molecule capable of preventing, in part or completely, or delaying the coalescence between neighboring fluid partitions of dispersed phase.

According to one embodiment, the dispersed phase contains a surfactant molecule capable of preventing, in part or completely, or delaying the coalescence between neighboring fluid partitions of dispersed phase.

According to one embodiment, the at least one fluid partitioning zone has a T-junction microchannel geometry, a flow focusing microchannel geometry or a co-flow microchannel geometry, similar to the ones described in Baroud, C. N., Gallaire, F., & Dangla, R. (2010). *Dynamics of microfluidic droplets. Lab on a Chip,* 10(16), 2032-2045 and familiar to a person skilled in the art.

According to one embodiment, the at least one fluid partitioning zone is located at the junction between a microchannel and a microchamber of the microfluidic network and consists in a step emulsification geometry, similar to the one described in Dangla, R., Fradet, E., Lopez, Y., & Baroud, C. N. (2013). *The physical mechanisms of step emulsification. Journal of Physics D: Applied Physics,* 46(11), 114003 and familiar to a person skilled in the art, wherein the width of the chamber is significantly greater than the width of the microchannel at the junction and the height of the chamber is also greater than the height of the microchannel at the junction.

According to one embodiment, the at least one fluid partitioning zone is located at the junction between a microchannel and a microchamber of the network of microchannels and consists in a sloped microchamber geometry, similar to the one described in Dangla, R., Kayi, S. C., & Baroud, C. N. (2013). *Droplet microfluidics driven by gradients of confinement. Proceedings of the National Academy of Sciences,* 110(3), 853-858 and Baroud, C., & Dangla, R. (2011). U.S. patent application Ser. No. 13/637,779, and familiar to a person skilled in the art, wherein the width of the chamber is significantly greater than the width of the microchannel at the junction and the height of the chamber increases progressively away from the junction. In such a configuration, the opposite top and bottom walls of said microchamber present a divergence in said partitioning zone.

Within said embodiment, the size of the droplets is substantially independent of the flow rate of the at least one second fluid. Indeed, the size of the droplets is a function of the geometrical parameters (i.e. section at the at least one microchannel at the junction with the at least one microchamber and divergence of the opposite walls). According to one embodiment, the divergence of the two opposite walls corresponds to a slope of one of the wall relative to the other ranging from 1% to 4%.

According to one embodiment, the network of microchannels further comprises at least one region for trapping the at least one dispersed phase.

According to one embodiment, said region for trapping the at least one dispersed phase consists in regions of the network of microchannels whose surfaces having differing affinities to fluid. For example but not limited to, the network of microchannels may comprise regions with increased hydrophilicity in order to favor the flow or trapping of droplets of an aqueous solution in these regions. Conversely, the network of microchannels may comprise regions with increased hydrophobicity in order to hinder the flow of droplets of an aqueous solution from these regions.

According to one embodiment, said region for trapping the at least one dispersed phase consists in at least one geometric constriction or enlargement of the at least one microchannel or of the at least one microchamber of the network of microchannels.

According to one embodiment, region for trapping the at least one dispersed phase is a microchamber comprising regions of small height, sized to crush droplets of the at least one dispersed phase, and regions of greater height is sized so as to reduce the crushing of the droplets or sized not to crush the droplets, in such a way that the droplets are drawn to and maintained into the regions of greater height of the microchannel.

According to one embodiment, the region of small height, sized to crush the droplets in the at least one microchamber, consists in a band on the perimeter of the microchamber and the region of greater height, sized so as to reduce the crushing of the droplets or sized not to crush the droplets, consists in a pocket in the center of the microchamber, closed by the band of small height, in such a way that, once droplets of the dispersed phase are introduced into the chamber through microchannels or fluid partitioning zones, they are drawn to the pocket in the center of the microchamber and forced to remain in the pocket.

According to one embodiment, the at least one microchannel comprises a plurality of microchambers. According to one embodiment, the at least one network of microchannels comprises 2, 4, 6, 8, 10, 12, 14, 16 microchambers. According to one embodiment, the plurality of microchamber are connected in series or in parallel by the at least one microchannel.

According to one embodiment, the at least one network of microchannels comprises at least one microchannel, at least one fluid partitioning zone for forming fluid partitions of at least one dispersed phase into at least one immiscible carrier and at least one region for trapping at least one dispersed phase downstream of the at least one fluid partitioning zone.

According to one embodiment, the at least one network of microchannels comprises a at least one microchannel and at least one microchamber between the at least one first port and the at least one second port; said at least one chamber having a height greater than that of the at least one microchannel; and at the at least one junction of the at least one microchannel into the at least one microchamber, the microchamber comprises at least two opposite walls that diverge relative to each other toward the at least one microchamber in order to give rise to droplets of the at least one dispersed phase.

The present invention also relates to a contact-less priming method for loading a solution in a microfluidic device comprising the following steps:

providing at least one microfluidic device comprising at least one microchannel, said at least one microfluidic device having at least one first port and at least one second port; wherein each of said first and seconds ports are fluidly connected to said at least one microchannel and wherein the at least one first port is suitable for containing at least one solution;

loading at least one solution in the at least one first port;

providing at least one closing member configured to close at least partially and/or to open at least partially a port, wherein said at least one closing member is disposed on the at least one first port or the at least one second port;

introducing and enclosing said at least one microfluidic device with the at least one closing member in a pressure chamber through at least one closable, gas tight aperture of said pressure chamber under atmospheric pressure; and pressurizing the pressure chamber.

According to one embodiment, the at least one closing member is configured such that the pressure applied in the pressure chamber is transmitted into said port with closing member in a different manner than it is transmitted into the other port, resulting in a pressure difference between the at least one first port and the at least second port, and thereby generating a flow of the at least one solution from the at least one first port to the at least one second port through the at least one microchannel.

According to one embodiment, the pressure exerted by the pressurization upon the at least one microfluidic device and the at least one closing member exerts a non-uniform pressure between the at least one first port and the at least second port thereby generating a flow of the at least one solution from the at least one first port to the at least one microchannel.

According to one embodiment, the closing member is configured such that when a pressure is exerted upon the at least one microfluidic device, said pressure is transmitted non-uniformly between the at least one first port and the at least second port; thereby generating a flow of the at least one solution from the at least one first port to the at least one microchannel.

According to one embodiment, as well known from one skilled in the art, the pressure chamber may be pressurized under positive pressure or depressurized under negative pressure.

According to one embodiment, the at least one microchannel comprises a network of microchannels.

According to one embodiment, the at least one closing member is selected from at least one stopper, at least one flow restrictor or at least one check-valve configured as an inward check-valve or outward check-valve.

According to one embodiment, the contact-less priming method according to the invention further comprises the step of loading at least one solution in the at least one second port.

According to one embodiment, the contact-less priming method further comprises the step of providing at least another closing member such that a closing member is disposed on each of the at least one first port and the at least one second port.

According to one embodiment, the at least another closing member is selected from at least one stopper, at least one flow restrictor or at least one check-valve configured as an inward check-valve or outward check-valve.

According to one embodiment, the contact-less priming method for loading a solution further comprises the step of providing at least one filter disposed on the at least one first port and/or the at least one second port prior to disposing the at least one microfluidic device in the pressure chamber. Said filter is permeable to gas while inhibiting liquid flow.

According to one embodiment, the contact-less priming method further comprises the step of returning pressure within the pressure chamber to atmospheric pressure.

According to one embodiment, the contact-less priming method further comprises the step of:

returning pressure within the pressure chamber to atmospheric pressure;

optionally, removing the at least one closing member from the at least one first port;

loading at least one second solution in the at least one first port;

optionally, placing again at least one closing member onto the at least one first port; and pressurizing the pressure chamber;

such that the at least one second solution flows from the at least one first port to the at least one microchannel.

According to one embodiment, the at least one solution (or carrier fluid) is a fluid which is not miscible with other fluids to be handled in the circuit. According to one embodiment, the at least one carrier fluid is generally oil, suitable for being supplemented with a surfactant additive product suitable for preventing the spontaneous merging of drops of a least one dispersed phase to be handled, if they come into contact. This surfactant additive may sometimes be unnecessary, according to the characteristics of the oil used as a carrier fluid and the at least one dispersed phase to be treated and analyzed.

According to one embodiment, the contact-less priming method further comprises the step of returning pressure within the pressure chamber to atmospheric pressure with back flow of the at least one solution from the at least one microchannel to the at least one first port.

According to an alternative embodiment, the contact-less priming method further comprises the step of returning pressure within the pressure chamber to atmospheric pressure without back flow of the at least one solution from the at least one microchannel to the at least one second port.

The contact-less priming method of the invention enables precise control of the quantity of the at least one solution injected within the at least one microchannel of the at least one microfluidic device. Indeed, the volume of the at least one solution that is injected into the network of microchannels is directly related to the level of pressure applied to the pressure chamber through the ideal gas law.

The relationship between the volume V of the at least one solution that is injected into the at least one microchannel and the pressure P that is applied to the pressure chamber is illustrated with the following embodiment. One microfluidic device comprising one microchannels connecting one first port to one second port is provided. One stopper, or cap, is placed onto said second port. One solution is loaded into said first port. A volume V0 of gas is then trapped between said solution loaded into said first port and said stopper placed onto said second port. Said volume V0 of gas is contained in the said microchannel and said second port. Said microfluidic device, prepared following such steps, is placed into one pressure chamber at the atmospheric pressure P0. Said pressure chamber is closed and an overpressure P is applied to the pressure chamber. The overpressure is applied to the said solution loaded into said first port but not to the fluid contained into said second port because of the said stopper. As a result, said solution is forced to flow into said microchannel. As it flows into said microchannel, it compresses the gas trapped between said solution and said stopper placed onto said second port. The flow of said solution stops when the pressure of said trapped gas equals the pressure applied to the pressure chamber and first port. The ideal gas law yields the corresponding volume V of said solution which is injected when the pressure equilibrium is reached: $V=V0\ (1-P0/P)$. The injected volume V is independent of the physical properties of said solution (density, viscosity, surface tension, etc . . . ). It only depends on the initial volume of trapped gas V0 and the applied overpressure P.

According to one embodiment, time-dependent pressure profiles are applied to the pressure chamber during pressurization. According to one embodiment, said pressure profile comprises at least one linear increase in pressure, at a fixed and controlled rate. For example, the pressure in said pressure chamber is increased linearly in time from the atmospheric pressure P0 to a required overpressure P at a fixed and controlled rate. According to one embodiment, the pressure profile comprises at least one quadratic increase in pressure, or at least one exponential increase, or at least one logarithmic increase, or any profile as required for the usage of said microfluidic device. According to one embodiment, the pressure profile features at least one pressure plateau.

According to one embodiment, the pressure profiles features at least one pressure decrease following any fixed and controlled profile as required for the usage of said microfluidic device.

The contact-less priming method of the invention also enable the qualitative control of the injection rate of the at least one solution within the at least one microchannel as the injection rate depends on the pressure profile but also on the physical properties of the at least one solution, such as its viscosity and surface tension.

According to one embodiment, the contact-less priming method further comprises controlling the temperature of said at least one microfluidic device while controlling the pressure in the pressure chamber, by controlling the temperature of the bottom plate of the pressure chamber onto which are placed said at least one microfluidic device using at least one heating element, such as a heating resistor or a Peltier element disposed under said bottom plate.

According to one embodiment, the contact-less priming method comprises applying a temperature treatment to the at least one solution that is or has been injected into said microchannel of said microfluidic network while controlling the pressure in the pressure chamber. According to one embodiment, said temperature treatment is applied by controlling the temperature of the bottom plate of the pressure chamber as described above.

According to one embodiment, said temperature treatment of said one solution involves cycling the temperature of said one solution such that said one solution undergoes a polymerase chain reaction to amplify the nucleic acids contained in said solution, as is familiar to one skilled in the art.

According to one embodiment, the contact-less priming method for loading droplets a solution in a microfluidic device comprises the following steps:

providing at least one microfluidic device comprising at least one networks of microchannel, said at least one microfluidic device having at least one first and at least one second port; wherein each of said first port and said second port is fluidly connected to said at least one microchannel;

the at least one first port is suitable for containing at least one solution;

the at least one network of microchannels comprises at least one microchannel and at least one fluid partitioning zone for forming fluid partitions of at least one dispersed phase into at least one immiscible carrier fluid;

loading at least one immiscible carrier fluid in the at least one first port or filing the at least one network of microchannels with at least one carrier fluid using for instance any method disclosed in the present invention;

loading at least one dispersed phase in the at least one first port;

providing at least one closing member configured to close at least partially and/or to open at least partially a port, wherein said at least one closing member is disposed on the at least one second port;

optionally, providing at least another closing member, wherein said at least another closing member is disposed on the at least one first port;

introducing and enclosing said at least one microfluidic device in a pressure chamber through at least one closable, gas tight aperture of said pressure chamber under atmospheric pressure; and pressurizing the pressure chamber.

According to one embodiment, the at least one closing member is configured such that the pressure applied in the pressure chamber is transmitted into said port with closing member in a different manner than it is transmitted into the other port, resulting in a pressure difference between the at least one first port and the at least second port, and thereby generating a flow of the at least one dispersed phase from the at least one first port to the at least one fluid partitioning zone and giving rise to fluid partitions (bubbles or droplets) of the at least one dispersed phase within the network of microchannels containing the immiscible carrier fluid.

According to one embodiment, the pressure exerted by the pressurization upon the at least one microfluidic device and the at least one closing member exerts a non-uniform pressure between the at least one first port and the at least second port thereby generating a flow of the at least one dispersed phase from the at least one first port to the at least one fluid partitioning zone and giving rise to fluid partitions (bubbles or droplets) of the at least one dispersed phase within the network of microchannels containing the immiscible carrier fluid.

According to one embodiment, the closing member is configured such that when a pressure is exerted upon the at least one microfluidic device, said pressure is transmitted non-uniformly between the at least one first port and the at least second port; thereby generating a flow of the at least one dispersed phase from the at least one first port to the at least one fluid partitioning zone and giving rise to fluid partitions (bubbles or droplets) of the at least one dispersed phase within the network of microchannels containing the immiscible carrier fluid.

It is noteworthy that the fluid partitions (bubbles or droplets) are produced in a particularly simple and effective manner within the microfluidic device according to the invention. Owing to the fluid partitioning method used, the flow rate at which the dispersed phase is injected through the fluid partitioning zone has only a very slight influence on the size of the drops produced. As a result, even though the contact-less priming method described above only allows to qualitatively control the injection flow rate of the dispersed phase, the fluid partitions formed still have homogeneous and reproducible dimensions.

According to one embodiment, the contact-less priming method for loading droplets of a solution further comprises applying a temperature treatment to the said fluid partitions of said at least one solution while controlling the pressure in the pressure chamber. According to one embodiment, said temperature treatment of said fluid partitions of said at least one solution involves cycling the temperature of said fluid partitions such that said at least one solution contained in said fluid partitions undergoes a polymerase chain reaction to amplify the nucleic acids contained in said fluid partitions of said at least one solution, thereby performing a digital PCR as familiar to one skilled in the art.

According to one embodiment, the contact-less priming method further comprises the step of returning pressure within the pressure chamber to atmospheric pressure.

According to one embodiment, as depicted in FIG. 1, without any closing member disposed on the at least one first port or the at least one second port, a uniform pressure is exerted on the at least one first port and the at least one second port, thus no flow of the at least one solution occurs.

According to an embodiment, the at least one closing member is at least one stopper disposed on the at least one second port. According to said embodiment, due to the at least one stopper, there is no fluid flow from the at least one second port to the pressure chamber and from the pressure chamber to the at least one second port via the at least one stopper. As a result, the pressure applied in the pressure chamber is not transmitted into the at least one second port through said at least one stopper.

According to one embodiment, the at least one closing member is at least one stopper and the at least one first port of the at least one microfluidic device comprises at least one solution. According to said embodiment, as depicted in FIG. 2, when the pressure chamber 1 is pressurized, the overpressure is not transmitted from the pressure chamber 1 to the at least one second port 4 via the at least one stopper 6, but is transmitted from the pressure chamber to the at least one first port 3, thus the at least one solution 11 flows from the at least one first port 3 to the at least one microchannel 5. Within said embodiment, if the pressure is reduced to the initial atmospheric pressure, the at least one solution will flow back to the at least one first port.

According to an alternative embodiment, if the pressure source operates under depressurization, the at least one stopper is disposed on the at least one first port.

According to one embodiment, the at least one closing member is at least one stopper, and the at least one first port and the at least one second port of the at least one microfluidic device comprises at least one solution. According to said embodiment, as depicted in FIG. 3, when the pressure chamber 1 is pressurized, the overpressure is not transmitted from the pressure chamber 1 to the at least one second port 4 via the at least one stopper 6, but is transmitted from the pressure chamber 1 to the at least one first port 3, thus the at least one solution 11 flows from the at least one first port 3 to the at least one microchannel 5. According to one embodiment, the fluid, such as air, contained initially within the at least one microchannel flows through the at least one solution of the at least one second port into the at least one second port. Within said embodiment, if the pressure is reduced to the initial atmospheric pressure, the at least one solution will flow back to the at least one first port. However, as there was initially at least one solution in the at least one second port, only said at least one solution and not air will flow back into the at least one microchannel. Thus within said embodiment, under atmospheric pressure, the at least one microfluidic channel is filled with the at least one solution.

According to an alternative embodiment, if the pressure source operates under depressurization, the at least one stopper is disposed on the at least one first port.

According to one embodiment, the contact-less priming method for loading droplets a solution in a microfluidic device comprises the following steps:

- providing at least one microfluidic device comprising at least one network of microchannels, said at least one microfluidic device having at least one first port and at least one second port; wherein
  - each of said first port and said second port is fluidly connected to said at least one network of microchannels;
  - the at least one first port is suitable for containing at least one solution;
  - the at least one network of microchannels comprises at least one microchannel and at least one fluid partitioning zone for forming fluid partitions of at least one dispersed phase into at least one immiscible carrier and at least one region for trapping at least one dispersed phase downstream of the at least one fluid partitioning zone;
- filing the at least one network of microchannels with at least one carrier fluid using for instance any method disclosed in the present invention;
- loading at least one dispersed phase in the at least one first port;
- providing at least one stopper, wherein said at least one stopper is disposed on the at least one second port;
- introducing and enclosing said at least one microfluidic device with the at least one stopper in a pressure chamber through at least one closable, gas tight aperture of said pressure chamber under atmospheric pressure; and
- pressurizing the pressure chamber.

According to one embodiment, the at least one stopper is configured such that the pressure exerted by the pressurization upon the at least one microfluidic device and the at least one stopper results in a pressure difference between the at least one first and the at least second port thereby generating a flow of the at least one dispersed phase from the at least one first port to the at least one network of microchannels and giving rise to droplets of the dispersed phase within the network of microchannels containing the carrier fluid.

As depicted in FIG. 4, when the pressure chamber 1 is pressurized, the overpressure is not transmitted from the pressure chamber 1 to the at least one second 4 via the at least one stopper 6, but is transmitted from the pressure chamber 1 to the at least one first port 3, thus the at least one dispersed phase 13 flows from the at least one first port 3 to the at least one network of microchannels 5. Said at least one dispersed phase 13 passes the at least one fluid partitioning zone (not represented), thereby giving rise to droplets of the at least one dispersed phase 13 within the at least one network of microchannels containing the carrier fluid 12.

Within said embodiment, if the pressure is reduced to the initial atmospheric pressure, the at least one carrier fluid 12 will flow back to the at least one first port 3 but the droplets of the at least one dispersed phase 13 will be trapped in the at least one region for trapping (not represented) the said dispersed phase.

According to an alternative embodiment, if the pressure source operates under depressurization, the at least one stopper is disposed on the at least one first port.

According to one embodiment, the contact-less priming method for loading droplets a solution in a microfluidic device comprising the following steps:

providing at least one microfluidic device comprising at least one network of microchannels, said at least one microfluidic device having at least one first port and at least one second port; wherein each of said first port and said second port is fluidly connected to said at least one network of microchannels;

the at least one first port is suitable for containing at least one solution;

the at least one second port is suitable for containing at least one solution;

the at least one network of microchannels comprises at least one microchannel and at least one fluid partitioning zone for forming fluid partitions of at least one dispersed phase into at least one immiscible carrier and at least one region for trapping at least one dispersed phase downstream of the at least one fluid partitioning zone;

loading at least one carrier fluid and at least one dispersed phase in the at least one first port;

loading at least one carrier fluid in the at least one second port;

providing at least one stopper, wherein said at least one stopper is disposed on the at least one second port;

introducing and enclosing said at least one microfluidic device with the at least one stopper in a pressure chamber through at least one closable, gas tight aperture of said pressure chamber under atmospheric pressure; and pressurizing the pressure chamber.

According to one embodiment, the at least one stopper is configured such that the pressure exerted by the pressurization upon the at least one microfluidic device and the at least one stopper results in a pressure difference between the at least one first port and the at least second port, thereby generating a flow of the at least one carrier fluid and of the at least one dispersed phase from the at least one first port to the at least one network of microchannels and giving rise to droplets of the dispersed phase within the network of microchannels containing the carrier fluid.

As depicted in FIG. 5, when the pressure chamber 1 is pressurized, the overpressure is not transmitted from the pressure chamber 1 to the at least one second port 4, but is transmitted from the pressure chamber 1 to the at least one first port 3, thus the at least one carrier fluid 12 and at least one dispersed phase 13 flows from the at least one first port 3 to the at least one network of microchannels 5.

Said at least one dispersed phase 13 passes the at least one fluid partitioning zone, thereby giving rise to droplets of the at least one dispersed phase 13 within the at least one network of microchannels 5 containing the first carrier fluid 12.

Within said embodiment, if the pressure is reduced to the initial atmospheric pressure, the at least one first carrier fluid 12 will flow back to the at least one first port 3 but the droplets of the at least one dispersed phase 13 will be trapped in the at least one region for trapping the said dispersed phase.

According to an alternative embodiment, if the pressure source operates under depressurization, the at least one stopper is disposed on the at least one first port.

According to one embodiment, as depicted in FIG. 6, the first port 3 is loaded with at least one carrier fluid 12, at least one dispersed phase 13 and at least one third solution 14, immiscible with the at least one dispersed phase, said at least one dispersed phase 13 being disposed in the at least one first port 3 between the at least one carrier fluid 12 and the at least one third solution 14. According to one embodiment, said third solution serves as a seal between said dispersed phase and the environment of the microfluidic device, preventing contaminations of said dispersed phase from the environment or preventing evaporation of said dispersed phase in the environment. According to one embodiment, said third solution allows to flow the total volume of said dispersed phase into said network of microchannels without introducing air into said network of microchannels. According to one embodiment, the second port is loaded with at least one carrier fluid and at least one third solution.

According to an embodiment, the at least one closing member is at least one flow restrictor disposed on the at least one second port. According to said embodiment, due to the at least one flow restrictor the fluid flow from the at least one second port to the pressure chamber or from the pressure chamber to the at least one second port via the at least one flow restrictor is relatively slower than the fluid flow from the at least one first port to the pressure chamber or from the pressure chamber to the at least one first port. As a result, the pressure applied into the pressure chamber is transmitted into said at least one second port with a delay.

According to one embodiment, the at least one closing member is at least one flow restrictor and the at least one first port of the at least one microfluidic device comprises at least one solution. According to said embodiment, as depicted in FIG. 7, when the pressure chamber 1 is pressurized, the overpressure is not transmitted homogeneously from the pressure chamber 1 to the at least one second port 4 and to the at least one first port 3; thus the at least one solution 11 flows from the at least one first port 3 to the at least one microchannel 5. Within said embodiment, if the pressure is reduced to the initial atmospheric pressure, depending of the pressure profile, the physical properties of the at least one solution and the flow restrictor, the at least one solution will not fully flow back to the at least one first port.

According to an alternative embodiment, if the pressure source operates under depressurization, the at least one flow restrictor is disposed on the at least one first port.

According to one embodiment, the contact-less priming method for loading droplets a solution in a microfluidic device comprises the following steps:

providing at least one microfluidic device comprising at least one network of microchannels, said at least one microfluidic device having at least one first port and at least one second port; wherein each of said first port and said second port is fluidly connected to said at least one network of microchannels;

the at least one first port is suitable for containing at least one solution;

the at least one network of microchannels comprises at least one microchannel and at least one fluid partitioning zone for forming fluid partitions of at least one dispersed phase into at least one immiscible carrier and at least one region for trapping at least one dispersed phase downstream of the at least one fluid partitioning zone;

filing the at least one network of microchannels with at least one carrier fluid using for instance any method disclosed in the present invention;

loading at least one dispersed phase in the at least one first port;

providing at least one flow restrictor, wherein said at least one flow restrictor is disposed on the at least one second port;

introducing and enclosing said at least one microfluidic device with the at least one solution and the at least one flow restrictor in a pressure chamber through at least one closable, gas tight aperture of said pressure chamber under atmospheric pressure; and pressurizing the pressure chamber.

According to one embodiment, the at least one flow restrictor is configured such that the pressure exerted upon the at least one microfluidic device and the at least one flow restrictor results in a pressure difference between the at least one first port and the at least second port, thereby generating a flow of the at least one dispersed phase from the at least one first port to the at least one network of microchannels and giving rise to droplets of the dispersed phase within the network of microchannels containing the carrier fluid.

As depicted in FIG. 8, when the pressure chamber 1 is pressurized, the overpressure is not equally transmitted from the pressure chamber 1 to the at least one second port 4 and to the at least one first port 3; thus the at least one dispersed phase 13 flows from the at least one first port 3 to the at least one network of microchannels 5. Said at least one dispersed phase 13 passes the at least one fluid partitioning zone (not represented), thereby giving rise to droplets of the at least one dispersed phase 13 within the at least one network of microchannels containing the carrier fluid 12.

Within said embodiment, if the pressure is reduced to the initial atmospheric pressure, the at least one carrier fluid 12 will at least partially flow back to the at least one first port but the droplets of the at least one dispersed phase 13 will be trapped in the at least one region for trapping the said dispersed phase (not represented).

According to an alternative embodiment, if the pressure source operates under depressurization, the at least one flow restrictor is disposed on the at least one first port.

According to one embodiment, the contact-less priming method for loading droplets a solution in a microfluidic device comprising the following steps:

providing at least one microfluidic device comprising at least one network of microchannels, said at least one microfluidic device having at least one first port and at least one second port; wherein each of said first port and said second port is fluidly connected to said at least one network of microchannels;

the at least one first port is suitable for containing at least one solution;

the at least one network of microchannels comprises at least one microchannel and at least one fluid partitioning zone for forming fluid partitions of at least one dispersed phase into at least one immiscible carrier and at least one region for trapping at least one dispersed phase downstream of the at least one fluid partitioning zone;

loading at least one carrier fluid and at least one dispersed phase in the at least one first port;

providing at least one flow restrictor, wherein said at least one flow restrictor is disposed on the at least one second port;

introducing and enclosing said at least one microfluidic device with the at least one carrier fluid, the at least one dispersed phase and the at least one flow restrictor in a pressure chamber through at least one closable, gas tight aperture of said pressure chamber under atmospheric pressure; and pressurizing the pressure chamber.

According to one embodiment, the at least one flow restrictor is configured such that the pressure exerted upon the at least one microfluidic device and the at least one flow restrictor results in a pressure difference between the at least one first port and the at least second port, thereby generating a flow of the at least one carrier fluid and of the at least one dispersed phase from the at least one first port to the at least one microchannel and giving rise to droplets of the at least one dispersed phase within the microchannel containing the carrier fluid.

As depicted in FIG. 9, when the pressure chamber 1 is pressurized, the overpressure is not equally transmitted from the pressure chamber 1 to the at least one second port 4 and to the at least one first port 3; thus the at least one carrier fluid 12 and the at least one dispersed phase 13 flow from the at least one first port 3. to the at least one network of microchannels 5. Said at least one dispersed phase 13 passes the at least one fluid partitioning zone (not represented), thereby giving rise to droplets of the at least one dispersed phase 13 within the at least one network of microchannels containing the carrier fluid 12.

Within said embodiment, if the pressure is reduced to the initial atmospheric pressure, the at least one carrier fluid will at least partially flow back to the at least one first port but the droplets of the at least one dispersed phase will be trapped in the at least one region for trapping the said dispersed phase.

According to an alternative embodiment, if the pressure source operates under depressurization, the at least one flow restrictor is disposed on the at least one first port.

According to one embodiment, as depicted in FIG. 10, the first port is loaded with at least one carrier fluid 12, at least one dispersed phase 13 and at least one third solution 14, immiscible with the at least one dispersed phase 13, said at least one dispersed phase 13 being disposed in the at least one first port 3 between said at least one carrier fluid 12 and at least one third solution 14.

According to an embodiment, the at least one closing member is at least one outward check-valve disposed on the at least one second port. According to said embodiment, due to the at least one outward check-valve, the fluid flow is allowed from the at least one second port to the pressure chamber via the at least one outward check-valve and is prevented from the pressure chamber to the at least one second port via the at least one outward one check-valve. According to one embodiment, the at least one outward check-valve is a plastic or metal ball disposed into said first or second port of said microfluidic device.

According to one embodiment, the at least one closing member is at least one outward check-valve and the at least one first port of the at least one microfluidic device comprises at least one solution. According to said embodiment, as depicted in FIG. 11, when the pressure chamber 1 is pressurized, the overpressure is not transmitted from the pressure chamber 1 to the at least one second port 4 via the at least one outward check-valve 8 but is transmitted from the pressure chamber 1 to the at least one first port 3, thus the at least one solution 11 flows from the at least one first port 3 to the at least one microchannel 5. Within said embodiment, if the pressure is reduced to the initial atmospheric pressure, the at least one solution 11 will not flow back to the at least one first port 3 as the air contained within the at least one microchannel 5 and the at least one second port 4 will flow to the pressure chamber 1 via the at least one outward check-valve 8.

According to an alternative embodiment, if the pressure source operates under depressurization, at least one inward check-valve is disposed on the at least one first port.

According to one embodiment, the contact-less priming method for loading droplets a solution in a microfluidic device comprises the following steps:

providing at least one microfluidic device comprising at least one network of microchannels, said at least one microfluidic device having at least one first port and at least one second port; wherein each of said first port and said second port is fluidly connected to said at least one network of microchannels;

the at least one first port is suitable for containing at least one solution;

the at least one network of microchannels comprises at least one microchannel and at least one fluid partitioning zone for forming fluid partitions of at least one dispersed phase into at least one immiscible carrier;

filing the at least one microchannel with at least one carrier fluid using for instance any method disclosed in the present invention;

loading at least one dispersed phase in the at least one first port;

providing at least one outward check-valve, wherein said at least outward one check-valve is disposed on the at least one second port;

introducing and enclosing said at least one microfluidic device with the at least one outward check-valve in a pressure chamber through at least one closable, gas tight aperture of said pressure chamber under atmospheric pressure; and pressurizing the pressure chamber.

According to one embodiment, the at least one outward check-valve is configured such that the pressure exerted upon the at least one microfluidic device and the at least one outward check-valve results in a pressure difference between the at least one first port and the at least second port thereby generating a flow of the at least one dispersed phase from the at least one first port to the at least one network of microchannels and giving rise to droplets of the dispersed phase within the network of microchannels containing the carrier fluid.

As depicted in FIG. 12, when the pressure chamber 1 is pressurized, the overpressure is not transmitted from the pressure chamber 1 to the at least one second port 4 via the at least one outward check-valve 8 but is transmitted from the pressure chamber 1 to the at least one first port 3, thus the at least one dispersed phase 13 flows from the at least one first port 3 to the at least one network of microchannels 5. Said at least one dispersed phase 13 passes the at least one fluid partitioning zone (not represented), thereby giving rise to droplets of the at least one dispersed phase 13 within the at least one network of microchannels 5 containing the carrier fluid 12.

Within said embodiment, if the pressure is reduced to the initial atmospheric pressure, the at least one carrier fluid and the droplets of the at least one dispersed phase will not flow back to the at least one first port as the air contained within the at least one second port and the at least one network of microchannels will flow to the pressure chamber via the at least one outward check-valve.

According to an alternative embodiment, if the pressure source operates under depressurization, at least one inward check-valve is disposed on the at least one first port.

According to one embodiment, the contact-less priming method for loading droplets a solution in a microfluidic device comprising the following steps:

providing at least one microfluidic device comprising at least one network of microchannels, said at least one microfluidic device having at least one first port and at least one second port; wherein each of said first port and said second port is fluidly connected to said at least one network of microchannels;

the at least one first port is suitable for containing at least one solution;

the at least one network of microchannels comprises at least one microchannel and at least one fluid partitioning zone for forming fluid partitions of at least one dispersed phase into at least one immiscible carrier;

loading at least one carrier fluid and at least one dispersed phase in the at least one first port;

providing at least one outward check-valve, wherein said at least one outward check-valve is disposed on the at least one second port;

introducing and enclosing said at least one microfluidic device with the at least one outward check-valve in a pressure chamber through at least one closable, gas tight aperture of said pressure chamber under atmospheric pressure; and pressurizing the pressure chamber.

According to one embodiment, the at least one outward check-valve is configured such that the pressure exerted upon the at least one microfluidic device and the at least one outward check-valve results in pressure difference between the at least one first port and the at least second port thereby generating a flow of the at least one carrier fluid and of the at least one dispersed phase from the at least one first port to the at least one network of microchannels and giving rise to droplets of the dispersed phase within the network of microchannels containing the carrier fluid.

As depicted in FIG. 13, when the pressure chamber 1 is pressurized, the overpressure is not transmitted from the pressure chamber 1 to the at least one second port 4 via the at least one outward check-valve 8 but is transmitted from the pressure chamber 1 to the at least one first port 3, thus the at least one carrier fluid 12 and the at least one dispersed phase 13 flow from the at least one first port 3 to the at least one network of microchannels 5. Said at least one dispersed phase 13 passes the at least one fluid partitioning zone (not represented), thereby giving rise to droplets of the at least one dispersed phase 13 within the at least one network of microchannels 5 containing the carrier fluid 12.

Within said embodiment, if the pressure is reduced to the initial atmospheric pressure, the at least one carrier fluid and the droplets of the at least one dispersed phase will not flow back to the at least one first port as the air contained within the network of microchannels and the at least one second port will flow to the pressure chamber via the at least one outward check-valve.

According to an alternative embodiment, if the pressure source operates under depressurization, at least one inward check-valve is disposed on the at least one first port.

According to one embodiment, as depicted in FIG. 14, the first port 3 is loaded with at least one carrier fluid 12, at least one dispersed phase 13 and at least one third solution 14, immiscible with the at least one dispersed phase 13, said at least one dispersed phase 13 being disposed in the at least one first port 3 between said at least one carrier fluid 12 and at least one third solution 14.

According to an embodiment, the at least one closing member is at least one stopper disposed on the at least one second port and the at least one another closing member is at least one inward check-valve disposed on the at least one first port. According to said embodiment, due to the at least one inward check-valve, the fluid flow is allowed from the at least one pressure chamber to the at least one first port and is prevented from the at least one first port to the pressure chamber via the at least one inward check-valve. According to said embodiment, there is no fluid flow from the at least one second port to the pressure chamber and from the pressure chamber to the at least one second port via the at least one stopper. According to said embodiment, as depicted in FIG. 15, when the pressure chamber 1 is pressurized, the overpressure is not transmitted from the pressure chamber 1 to the at least one second port 4 via the at least one stopper 6, but is transmitted from the pressure chamber 1 to the at least one first port 3 via the at least one inward check-valve 7, thus the at least one solution 11 flows from the at least one first port to the at least one microchannel 5. Within said embodiment, if the pressure is reduced to the initial atmospheric pressure, the at least one solution 11 will not flow back to the at least one first port 3 as the pressure is maintained within the at least one microfluidic device.

According to an alternative embodiment, if the pressure source operates under depressurization, at least one stopper is disposed on the at least one first port and at least one outward check-valve is disposed on the at least one second port.

According to one embodiment, the contact-less priming method for loading droplets a solution in a microfluidic device comprises the following steps:

- providing at least one microfluidic device comprising at least one network of microchannels, said at least one microfluidic device having at least one first port and at least one second port; wherein
  - each of said first port and said second port is fluidly connected to said at least one network of microchannels;
  - the at least one first port is suitable for containing at least one solution;
  - the at least one network of microchannels comprises at least one microchannel and at least one fluid partitioning zone for forming fluid partitions of at least one dispersed phase into at least one immiscible carrier;
- loading at least one carrier fluid in the at least one first port;
- loading at least one dispersed phase in the at least one first port;
- providing at least one stopper, wherein said at least one stopper is disposed on the at least one second port;
- providing at least one inward check-valve, wherein said at least one inward check-valve is disposed on the at least one first port;
- introducing and enclosing said at least one microfluidic device with the at least one stopper and the at least one check-valve in a pressure chamber through at least one closable, gas tight aperture of said pressure chamber under atmospheric pressure; and
- pressurizing the pressure chamber.

According to one embodiment, the at least one stopper and the at least one inward check-valve are configured such that the pressure exerted upon the at least one microfluidic device and the at least one inward check-valve and the at least one stopper results in a pressure difference between the at least one first port and the at least second port, thereby generating a flow of the at least one carrier fluid and one dispersed phase from the at least one first port to the at least one network of microchannels and giving rise to droplets of the dispersed phase within the network of microchannels containing the carrier fluid.

As depicted in FIG. 16, when the pressure chamber 1 is pressurized, the overpressure is not transmitted from the pressure chamber 1 to the at least one second port 4 via the at least one stopper 6, but is transmitted from the pressure chamber 1 to the at least one first port 3 via the at least one inward check-valve 7, thus the at least one carrier fluid 12 and the at least one dispersed phase 13 solution flows from the at least one first port 3 to the at least one network of microchannels 5. Said at least one dispersed phase 13 passes the at least one fluid partitioning zone (not represented), thereby giving rise to droplets of the at least one dispersed phase 13 within the at least one network of microchannels 5 containing the carrier fluid 12.

Within said embodiment, if the pressure is reduced to the initial atmospheric pressure, the at least one carrier fluid 12 and the droplets of the dispersed phase 13 will not flow back to the at least one first port 3 as the pressure is maintained within the at least one microfluidic device by the at least one inward check-valve 7 disposed onto the at least one first port 3.

According to an alternative embodiment, if the pressure source operates under depressurization, at least one stopper is disposed on the at least one first port and at least one outward check-valve is disposed on the at least one second port.

According to one embodiment, as depicted in FIG. 17, the first port 3 is loaded with at least one carrier fluid 12, at least one dispersed phase 13 and at least one third solution 14, immiscible with the at least one dispersed phase 13, said at least one dispersed phase 13 being disposed in the at least one first port 3 between said at least one carrier fluid 12 and at least one third solution 14.

According to an embodiment, the at least one closing member is at least one outward check-valve disposed on the at least one second port and the at least one another closing member is at least one inward check-valve disposed on the at least one first port. According to said embodiment, due to the at least one outward check-valve, the fluid flow is allowed from the at least one second port to the pressure chamber and is prevented from the pressure chamber to the at least one second port via the at least one outward check-valve. According to said embodiment, due to the at least one inward check-valve, the fluid flow is allowed from the at least one pressure chamber to the at least one first port and is prevented from the at least one first port to the pressure chamber via the at least one inward check-valve. As depicted in FIG. 18, when the pressure chamber 1 is pressurized, the overpressure is not transmitted from the pressure chamber 1 to the at least one second port 4 via the at least one outward check-valve 8, but is transmitted from the pressure chamber 1 to the at least one first port 3 via the at least one inward check-valve 7, thus the at least one solution 11 flows from the at least one first port 3 to the at least one microchannel 5. Within said embodiment, if the pressure is reduced to the initial atmospheric pressure, the at least one solution 11 will flow further within the at least one microchannel 5 as (1) the air contained within the at least one first port 3 may not flow to the pressure chamber 1 via the at least one inward check-valve 7 disposed on the at least one first port 3 and (2) the air contained within the at least one second port 4 may flow to the pressure chamber 1 via the at least one outward check-valve 8 disposed on the at least one second port 4. Thus, the pressurized air within the at least one first port pushes the at least one solution further within the at least one microchannel. Within said embodiment, the flow of solution remains in the same direction when an overpressure is applied and then when the pressure is reduced to the initial atmospheric pressure.

According to an alternative embodiment, the pressure source operates under depressurization.

According to one embodiment, the contact-less priming method for loading droplets a solution in a microfluidic device comprises the following steps:

providing at least one microfluidic device comprising at least one network of microchannels, said at least one microfluidic device having at least one first port and at least one second port; wherein each of said first port and said second port is fluidly connected to said at least one network of microchannels;

the at least one first port is suitable for containing at least one solution;

the at least one network of microchannels comprises at least one microchannel and at least one fluid partitioning zone for forming fluid partitions of at least one dispersed phase into at least one immiscible carrier;

loading at least one carrier fluid in the at least one first port;

loading at least one dispersed phase in the at least one first port;

providing at least one outward check-valve, wherein said at least one outward check-valve is disposed on the at least one second port;

providing at least one inward check-valve, wherein said at least one inward check-valve is disposed on the at least one first port;

introducing and enclosing said at least one microfluidic device with the at least one inward check-valve and the at least one outward check-valve in a pressure chamber through at least one closable, gas tight aperture of said pressure chamber under atmospheric pressure; and pressurizing the pressure chamber.

According to one embodiment, the at least one inward and one outward check-valves are configured such that the pressure exerted upon the at least one microfluidic device and the at least one inward check-valve and the at least one outward check-valve results in a pressure difference between the at least one first port and the at least second port thereby generating a flow of the at least one carrier fluid and the at least one dispersed phase from the at least one first port to the at least one network of microchannels and giving rise to droplets of the dispersed phase within the network of microchannels containing the carrier fluid.

As depicted in FIG. 19, when the pressure chamber 1 is pressurized, the overpressure is not transmitted from the pressure chamber 1 to the at least one second port 4 via the at least one outward check-valve 8, but is transmitted from the pressure chamber 1 to the at least one first port 3 via the at least one inward check-valve 7, thus the at least one carrier fluid 12 and the at least one dispersed phase 13 flows from the at least one first port 3 to the at least one network of microchannels 5. Said at least one dispersed phase 13 passes the at least one fluid partitioning zone (not represented), thereby giving rise to droplets of the at least one dispersed phase 13 within the at least one network of microchannels 5 containing the carrier fluid 12. Within said embodiment, if the pressure is reduced to the initial atmospheric pressure, the at least one carrier fluid 12 and at least one dispersed phase 13 will flow further within the at least one network of microchannels 5 as (1) the air contained within the at least one first port 3 may not flow to the pressure chamber 1 via the at least one inward check-valve 7 disposed on the at least one first port 3 and (2) the air contained within the at least one second port 4 may flow to the pressure chamber 1 via the at least one outward check-valve 8 disposed on the at least one second port 4. Thus, the pressurized air within the at least one first port pushes the at least one carrier fluid and the at least one dispersed phase further within the at least one network of microchannels. Within said embodiment, the flow of solution remains in the same direction when an overpressure is applied and then when the pressure is reduced to the initial atmospheric pressure.

According to an alternative embodiment, the pressure source operates under depressurization.

According to one embodiment, as depicted in FIG. 20, the first port 3 is loaded with at least one carrier fluid 12, at least one dispersed phase 13 and at least one third solution 14, immiscible with the at least one dispersed phase 13, said at least one dispersed phase 13 being disposed in the at least one first port 3 between said at least one carrier fluid 12 and said at least one third solution 14.

While various embodiments have been described and illustrated, the detailed description is not to be construed as being limited hereto. Various modifications can be made to the embodiments by those skilled in the art without departing from the true spirit and scope of the disclosure as defined by the claims.

BRIEF DESCRIPTION OF THE DRAWINGS

FIG. 21 illustrates a system according to the present invention. In particular.

REFERENCES

Figure 1:
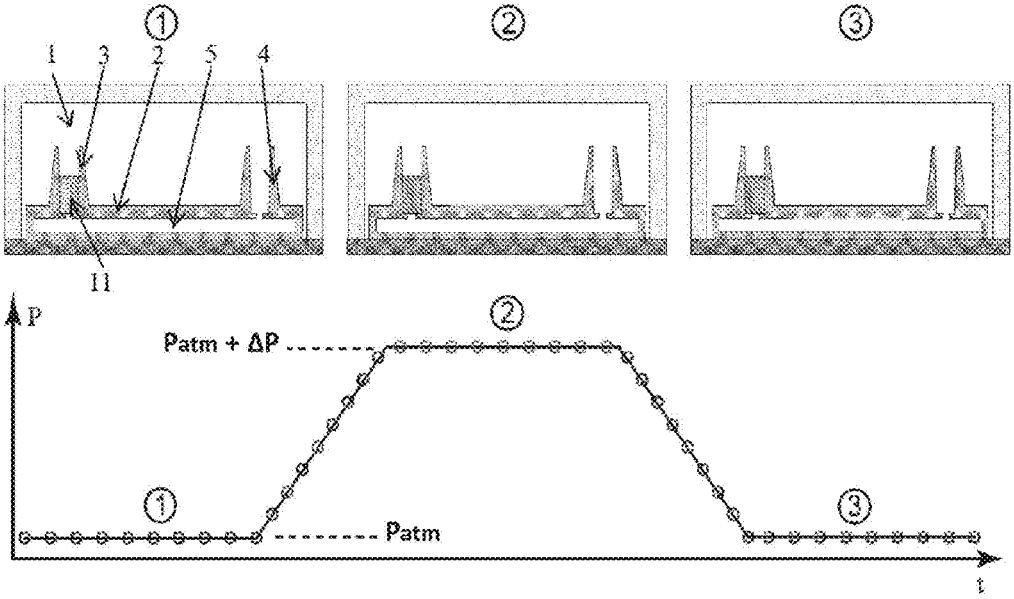
FIG. 1 illustrates a microfluidic device according to the present invention comprising no closing member disposed on the second port and no closing member disposed on the first port; said microfluidic device comprising a solution in the first port and said microfluidic device being disposed in a pressure chamber. Said pressure chamber being first under atmospheric pressure (1), then pressurized (2) and finally under atmospheric pressure (3). The pressure within the pressure chamber is represented by a continuous line while the pressure within the microfluidic device is represented by a series of circles.
Figure 2:
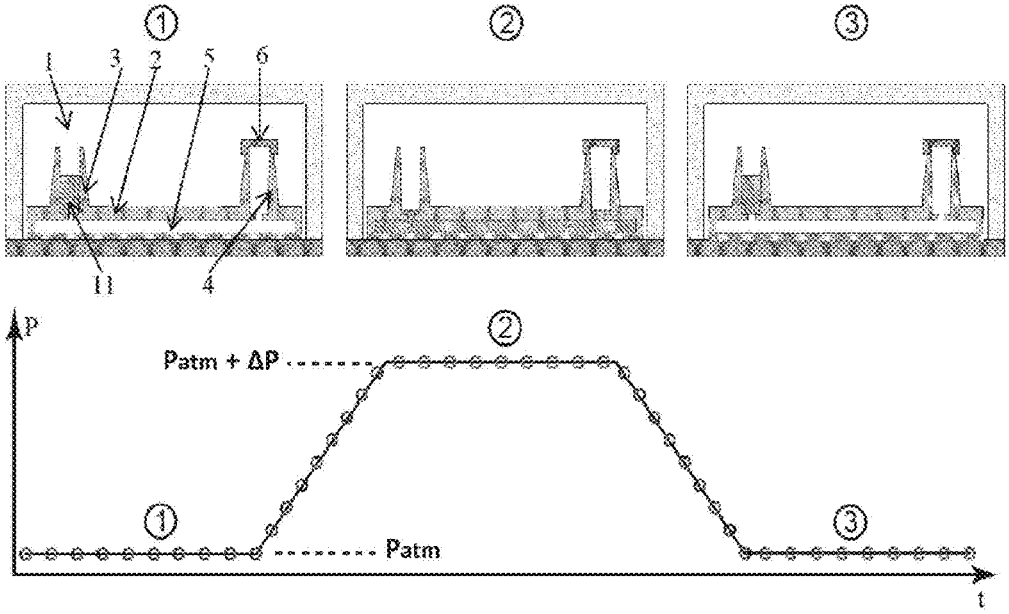
FIG. 2 illustrates a microfluidic device according to the present invention comprising a stopper disposed on the second port and no closing member disposed on the first port; said microfluidic device comprising a solution in the first port and said microfluidic device being disposed in a pressure chamber. Said pressure chamber being first under atmospheric pressure (1), then pressurized (2) and finally under atmospheric pressure (3). The pressure within the pressure chamber is represented by a continuous line while the pressure within the microfluidic device is represented by a series of circles.
Figure 3:
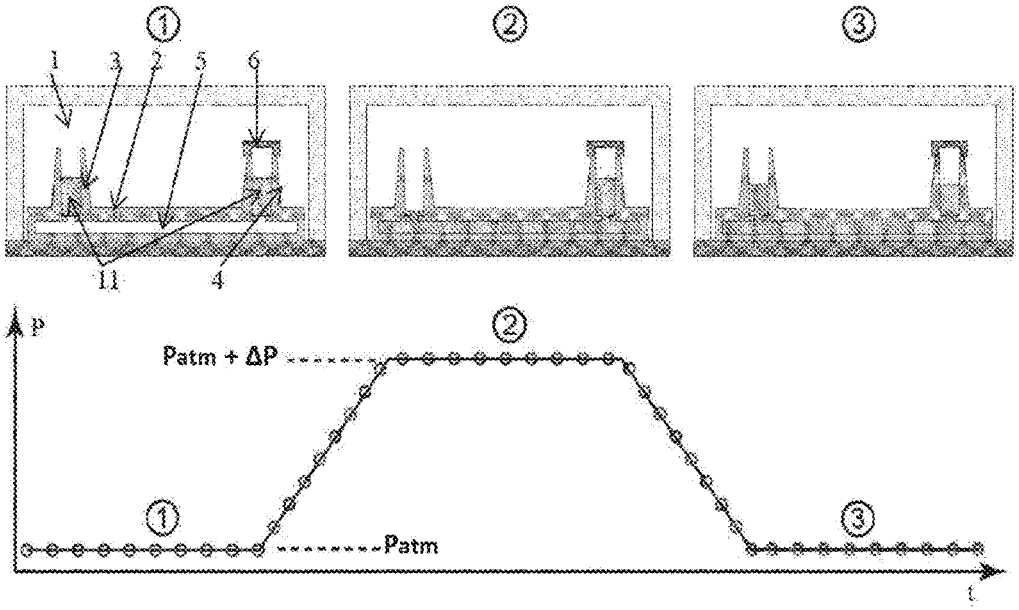
FIG. 3 illustrates a microfluidic device according to the present invention comprising a stopper disposed on the second port and no closing member disposed on the first port; said microfluidic device comprising a solution in the first port and in the second port; and said microfluidic device being disposed in a pressure chamber. Said pressure chamber being first under atmospheric pressure (1), then pressurized (2) and finally under atmospheric pressure (3). The pressure within the pressure chamber is represented by a continuous line while the pressure within the microfluidic device is represented by a series of circles.
Figure 4:
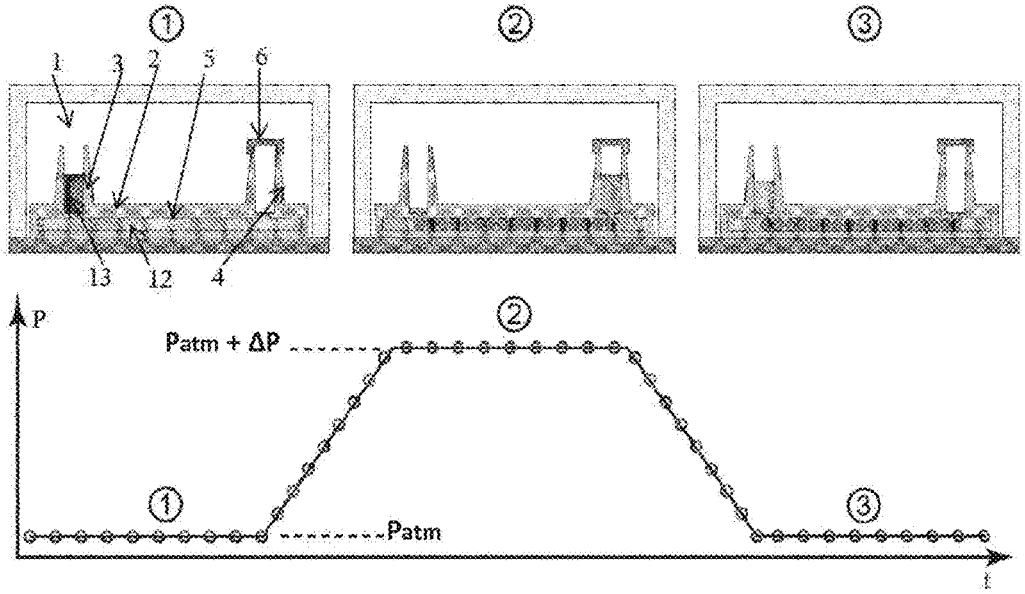
FIG. 4 illustrates a microfluidic device according to the present invention comprising a stopper disposed on the second port and no closing member disposed on the first port; said microfluidic device comprising a carrier fluid in the microfluidic network and a dispersed phase in the first port; and said microfluidic device being disposed in a pressure chamber. Said pressure chamber being first under atmospheric pressure (1), then pressurized (2) and finally under atmospheric pressure (3). The pressure within the pressure chamber is represented by a continuous line while the pressure within the microfluidic device is represented by a series of circles.
Figure 5:
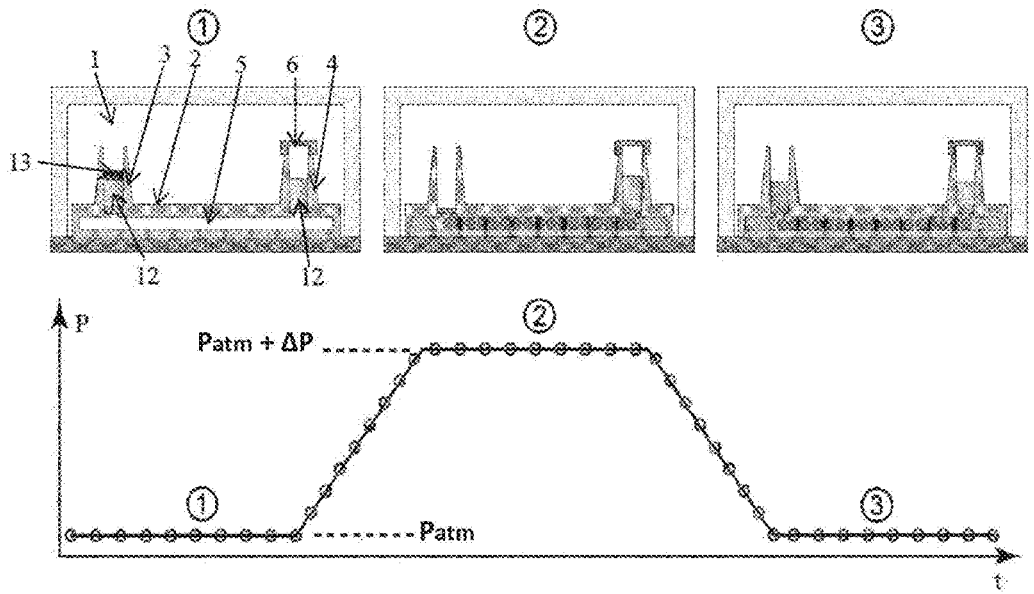
FIG. 5 illustrates a microfluidic device according to the present invention comprising a stopper disposed on the second port and no closing member disposed on the first port; said microfluidic device comprising a carrier fluid and a dispersed phase in the first port and the carrier fluid in the second port; and said microfluidic device being disposed in a pressure chamber. Said pressure chamber being first under atmospheric pressure (1), then pressurized (2) and finally under atmospheric pressure (3). The pressure within the pressure chamber is represented by a continuous line while the pressure within the microfluidic device is represented by a series of circles.
Figure 6:
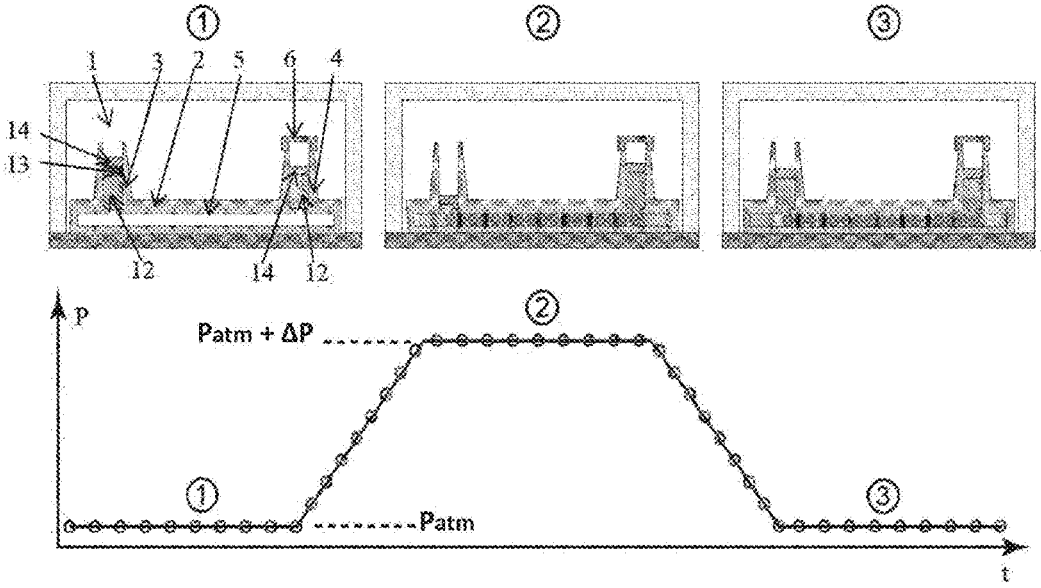
FIG. 6 illustrates a microfluidic device according to the present invention comprising a stopper disposed on the second port and no closing member disposed on the first port; said microfluidic device comprising a carrier fluid, a dispersed phase and a third solution immiscible with the dispersed phase in the first port and the carrier fluid and the third solution in the second port; and said microfluidic device being disposed in a pressure chamber. Said pressure chamber being first under atmospheric pressure (1), then pressurized (2) and finally under atmospheric pressure (3). The pressure within the pressure chamber is represented by a continuous line while the pressure within the microfluidic device is represented by a series of circles.
Figure 7:
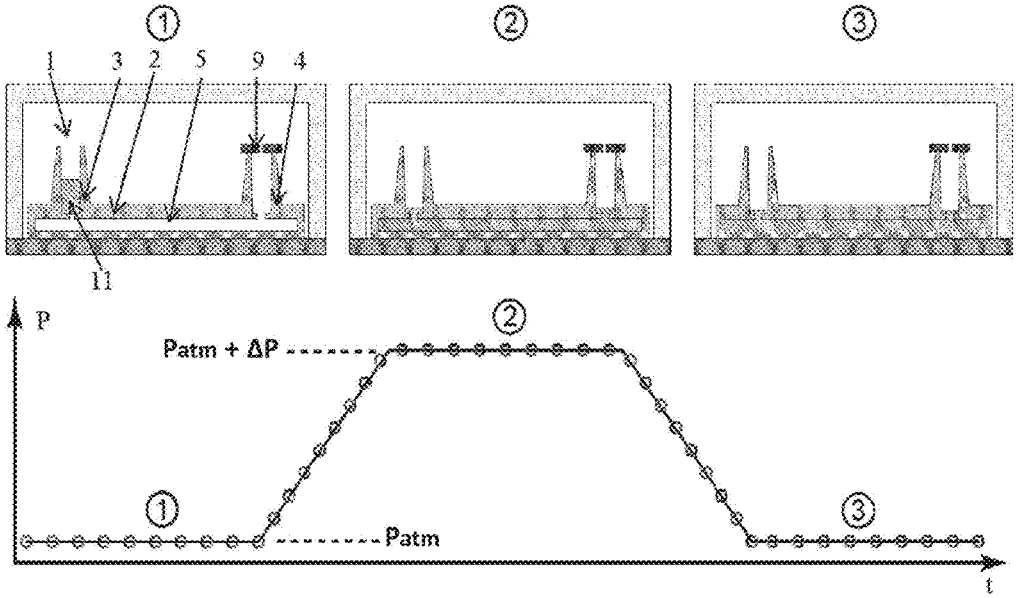
FIG. 7 illustrates a microfluidic device according to the present invention comprising a flow restrictor disposed on the second port and no closing member disposed on the first port; said microfluidic device comprising a solution in the first port and said microfluidic device being disposed in a pressure chamber. Said pressure chamber being first under atmospheric pressure (1), then pressurized (2) and finally under atmospheric pressure (3). The pressure within the pressure chamber is represented by a continuous line while the pressure within the microfluidic device is represented by a series of circles.
Figure 8:
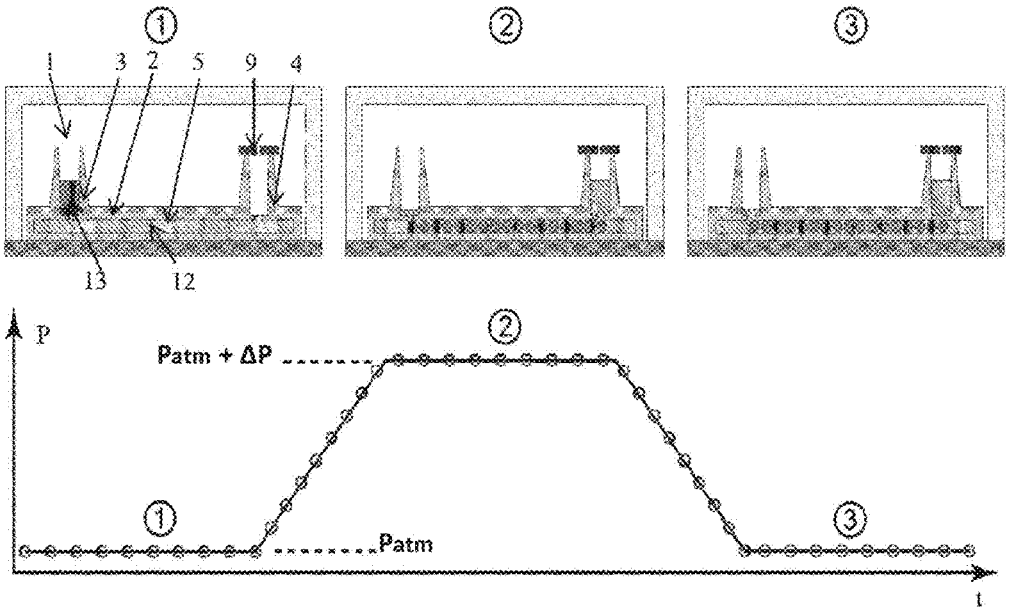
FIG. 8 illustrates a microfluidic device according to the present invention comprising a flow restrictor disposed on the second port and no closing member disposed on the first port; said microfluidic device comprising a carrier fluid in the microfluidic network and a dispersed phase in the first port; and said microfluidic device being disposed in a pressure chamber. Said pressure chamber being first under atmospheric pressure (1), then pressurized (2) and finally under atmospheric pressure (3). The pressure within the pressure chamber is represented by a continuous line while the pressure within the microfluidic device is represented by a series of circles.
Figure 9:
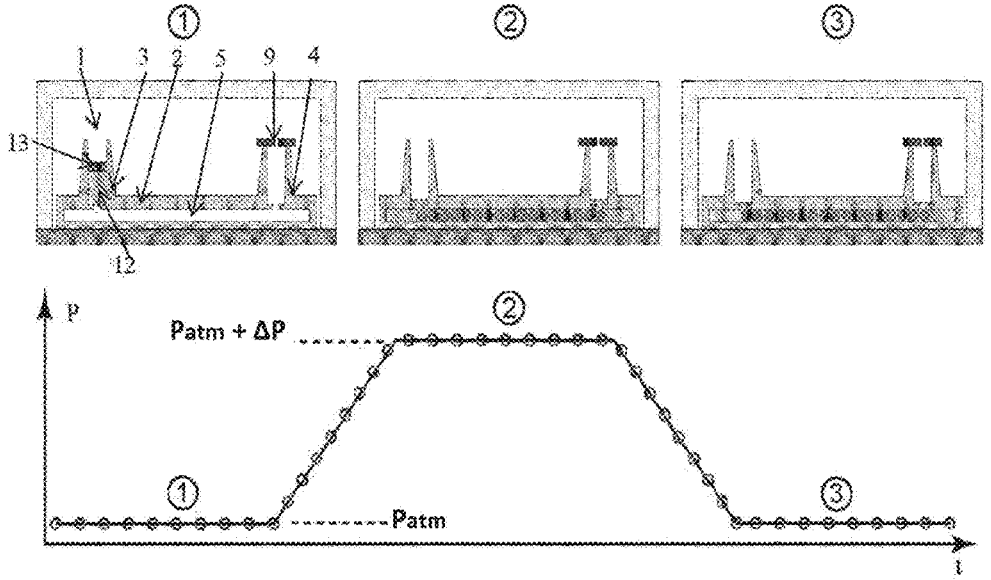
FIG. 9 illustrates a microfluidic device according to the present invention comprising a flow restrictor disposed on the second port and no closing member disposed on the first port; said microfluidic device comprising a carrier fluid and a dispersed phase in the first port; and said microfluidic device being disposed in a pressure chamber. Said pressure chamber being first under atmospheric pressure (1), then pressurized (2) and finally under atmospheric pressure (3). The pressure within the pressure chamber is represented by a continuous line while the pressure within the microfluidic device is represented by a series of circles.
Figure 10:
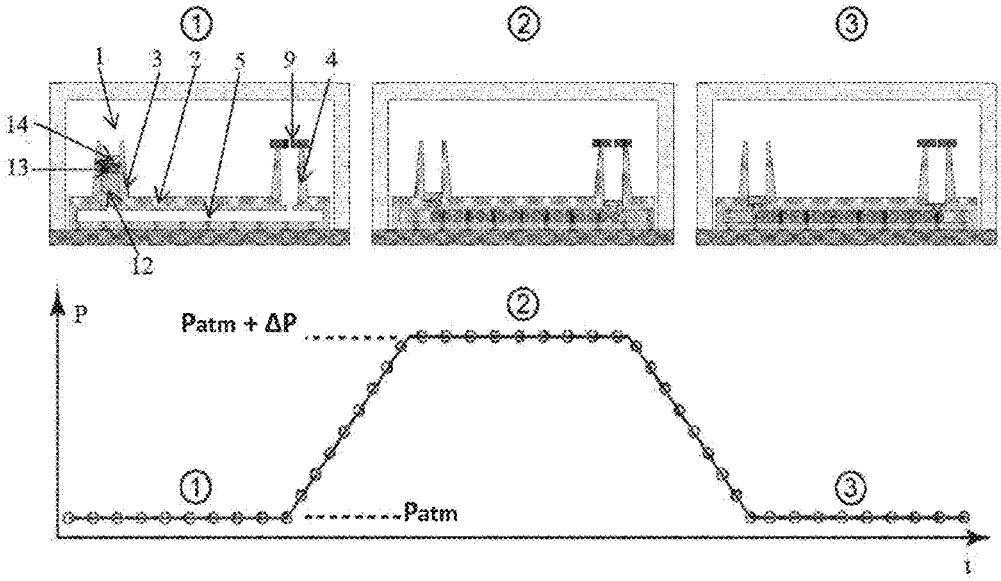
FIG. 10 illustrates a microfluidic device according to the present invention comprising a flow restrictor disposed on the second port and no closing member disposed on the first port; said microfluidic device comprising a carrier fluid, a dispersed phase and a third solution immiscible with the dispersed phase in the first port; and said microfluidic device being disposed in a pressure chamber. Said pressure chamber being first under atmospheric pressure (1), then pressurized (2) and finally under atmospheric pressure (3). The pressure within the pressure chamber is represented by a continuous line while the pressure within the microfluidic device is represented by a series of circles.
Figure 11:
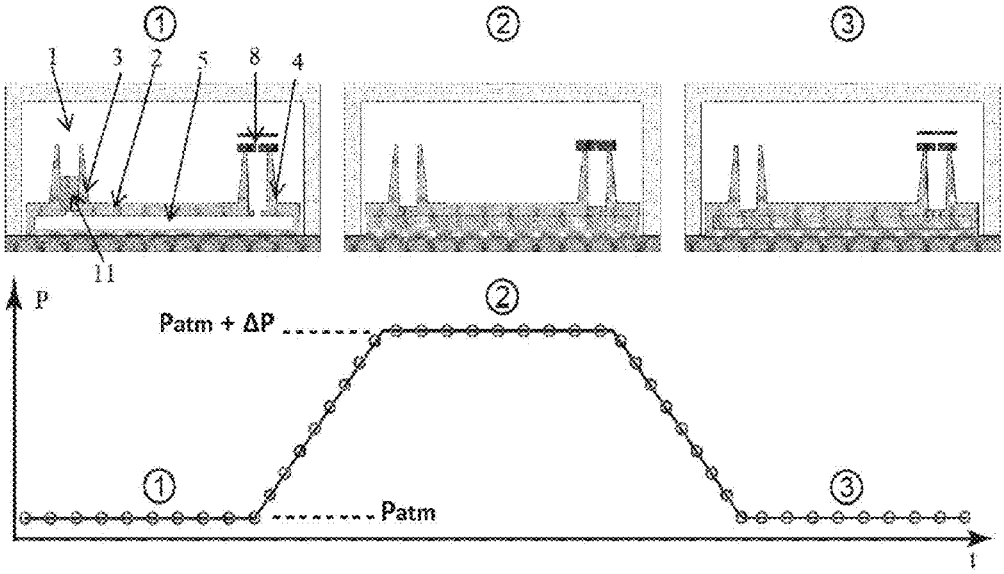
FIG. 11 illustrates a microfluidic device according to the present invention comprising an outward check-valve disposed on the second port and no closing member disposed on the first port; said microfluidic device comprising a solution in the first port and said microfluidic device being disposed in a pressure chamber. Said pressure chamber being first under atmospheric pressure (1), then pressurized (2) and finally under atmospheric pressure (3). The pressure within the pressure chamber is represented by a continuous line while the pressure within the microfluidic device is represented by a series of circles.
Figure 12:
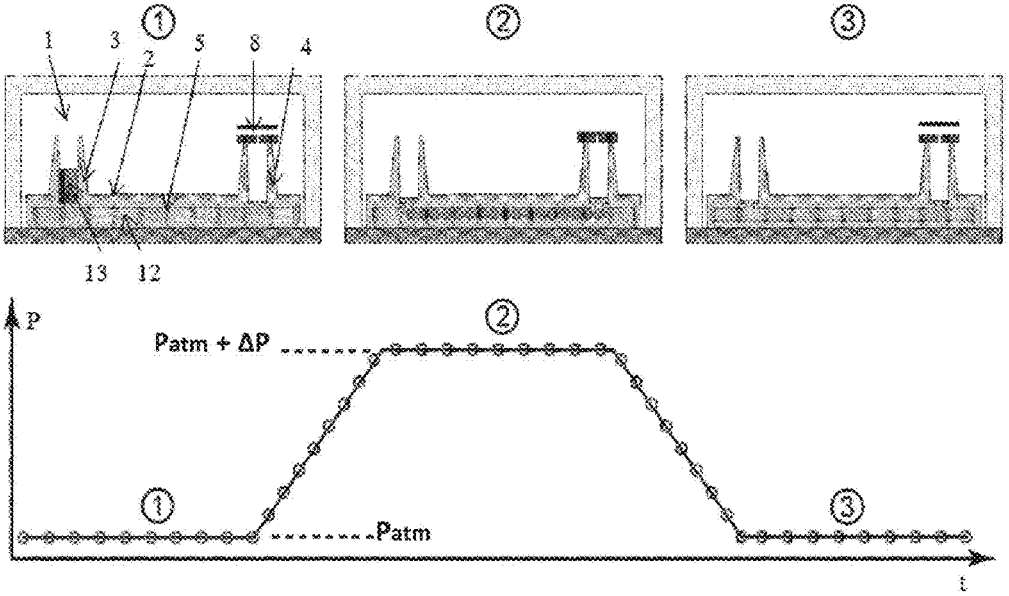
FIG. 12 illustrates a microfluidic device according to the present invention comprising an outward check-valve disposed on the second port and no closing member disposed on the first port; said microfluidic device comprising a carrier fluid in the microfluidic network and a dispersed phase in the first port; and said microfluidic device being disposed in a pressure chamber. Said pressure chamber being first under atmospheric pressure (1), then pressurized (2) and finally under atmospheric pressure (3). The pressure within the pressure chamber is represented by a continuous line while the pressure within the microfluidic device is represented by a series of circles.
Figure 13:
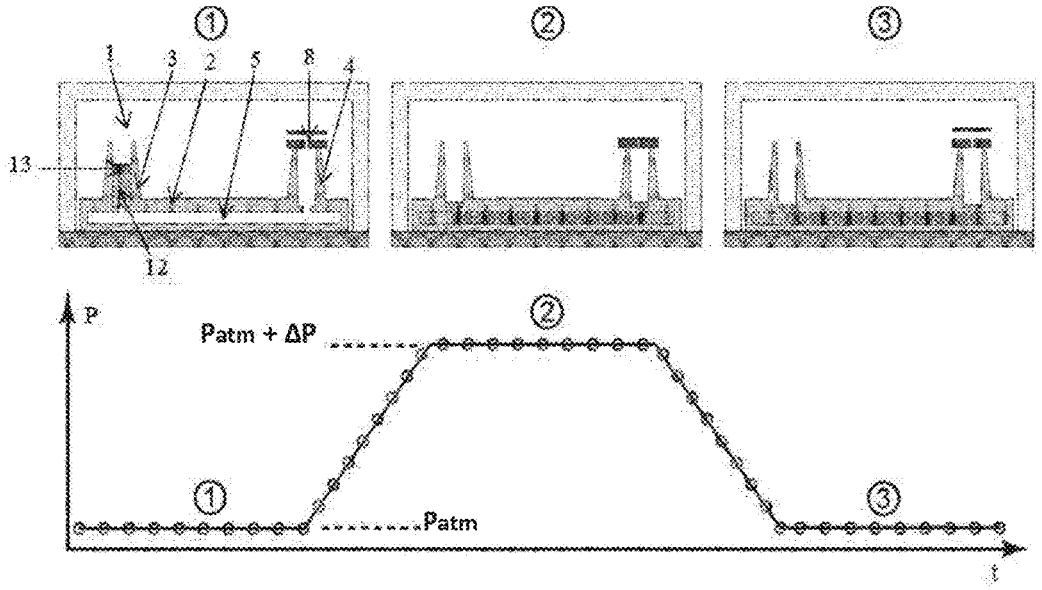
FIG. 13 illustrates a microfluidic device according to the present invention comprising an outward check-valve disposed on the second port and no closing member disposed on the first port; said microfluidic device comprising a carrier fluid and a dispersed phase in the first port; and said microfluidic device being disposed in a pressure chamber. Said pressure chamber being first under atmospheric pressure (1), then pressurized (2) and finally under atmospheric pressure (3). The pressure within the pressure chamber is represented by a continuous line while the pressure within the microfluidic device is represented by a series of circles.
Figure 14:
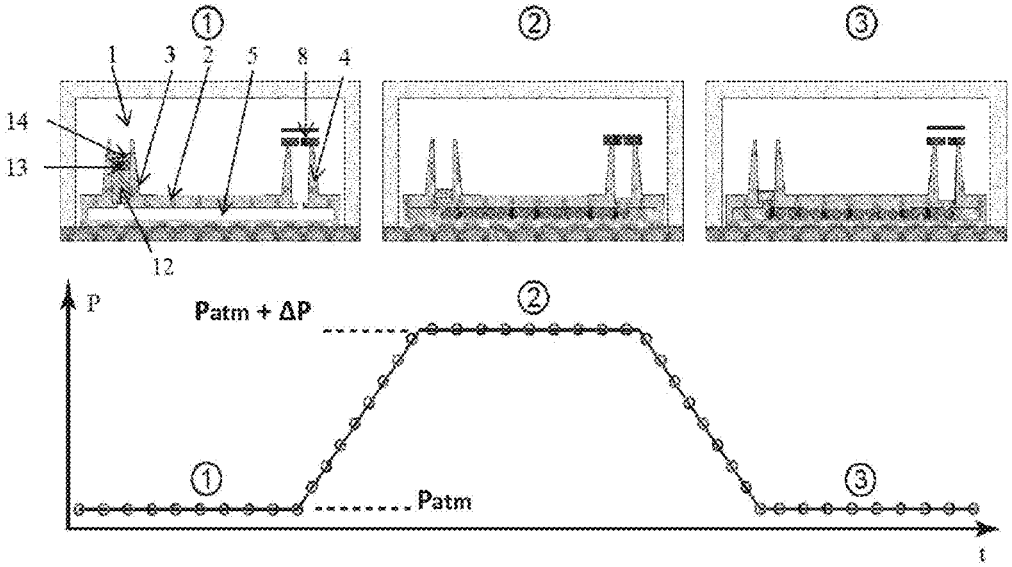
FIG. 14 illustrates a microfluidic device according to the present invention comprising an outward check-valve disposed on the second port and no closing member disposed on the first port; said microfluidic device comprising a carrier fluid, a dispersed phase and a third solution immiscible with the dispersed phase in the first port; and said microfluidic device being disposed in a pressure chamber. Said pressure chamber being first under atmospheric pressure (1), then pressurized (2) and finally under atmospheric pressure (3). The pressure within the pressure chamber is represented by a continuous line while the pressure within the microfluidic device is represented by a series of circles.
Figure 15:
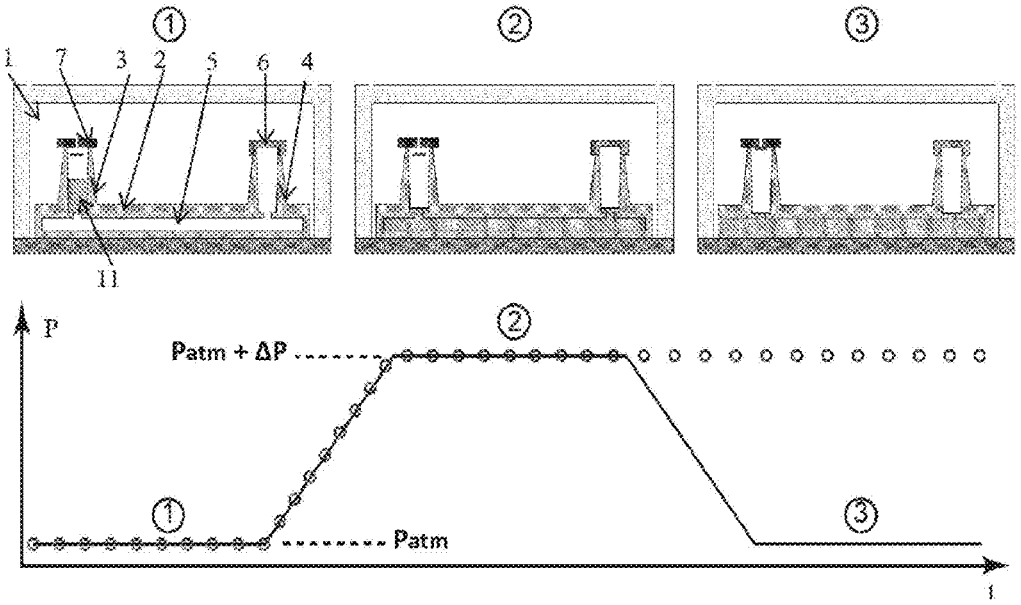
FIG. 15 illustrates a microfluidic device according to the present invention comprising an inward check-valve disposed on the first port and a stopper disposed on the second port; said microfluidic device comprising a solution in the first port and said microfluidic device being disposed in a pressure chamber. Said pressure chamber being first under atmospheric pressure (1), then pressurized (2) and finally under atmospheric pressure (3). The pressure within the pressure chamber is represented by a continuous line while the pressure within the microfluidic device is represented by a series of circles.
Figure 16:
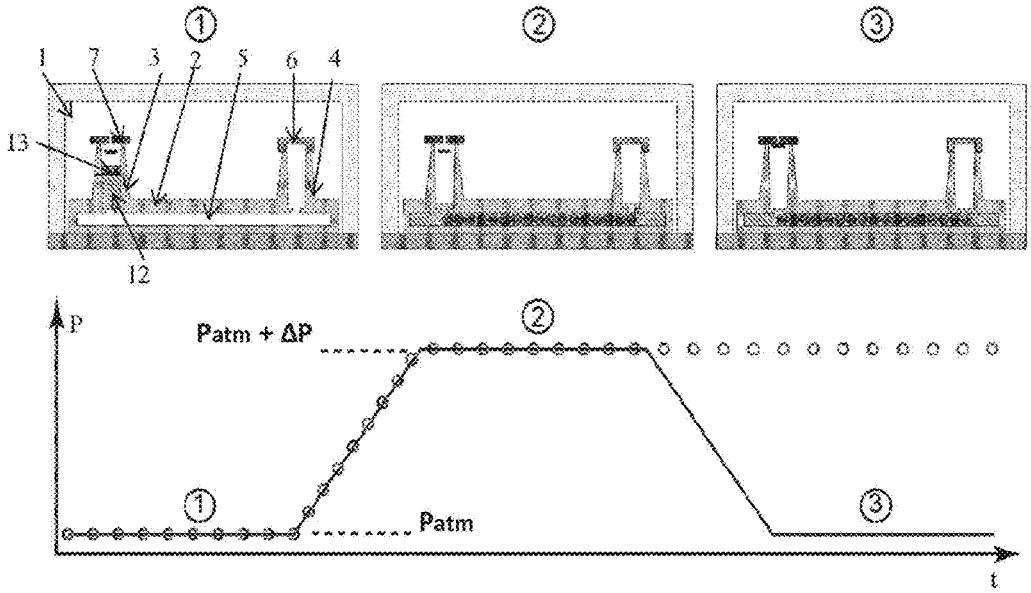
FIG. 16 illustrates a microfluidic device according to the present invention comprising an inward check-valve disposed on the first port and a stopper disposed on the second port; said microfluidic device comprising a carrier fluid and a dispersed phase in the first port; and said microfluidic device being disposed in a pressure chamber. Said pressure chamber being first under atmospheric pressure (1), then pressurized (2) and finally under atmospheric pressure (3). The pressure within the pressure chamber is represented by a continuous line while the pressure within the microfluidic device is represented by a series of circles.
Figure 17:
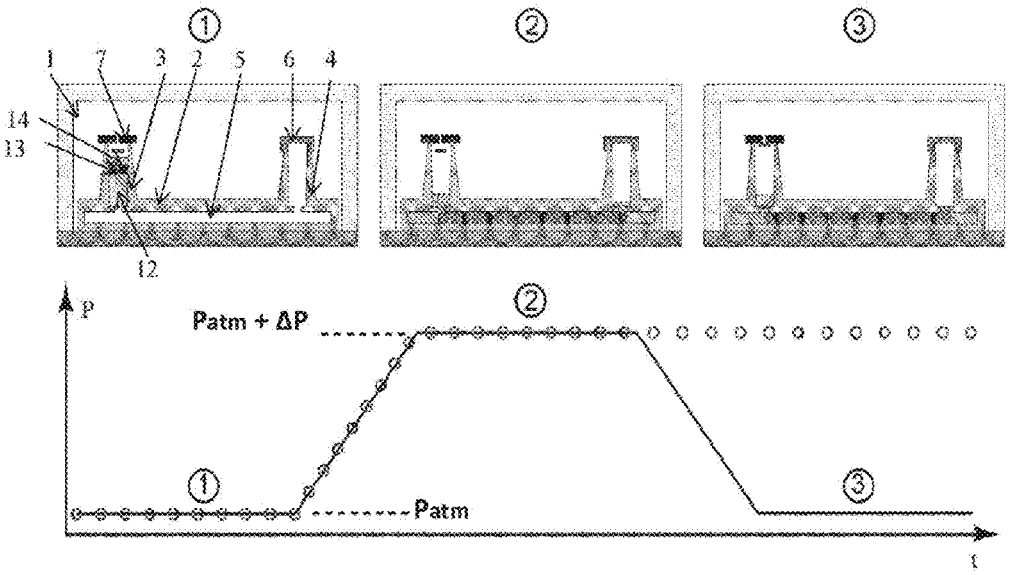
FIG. 17 illustrates a microfluidic device according to the present invention comprising an inward check-valve disposed on the first port and a stopper disposed on the second port; said microfluidic device comprising a carrier fluid, a dispersed phase and a third solution immiscible with the dispersed phase in the first port; and said microfluidic device being disposed in a pressure chamber. Said pressure chamber being first under atmospheric pressure (1), then pressurized (2) and finally under atmospheric pressure (3). The pressure within the pressure chamber is represented by a continuous line while the pressure within the microfluidic device is represented by a series of circles.
Figure 18:
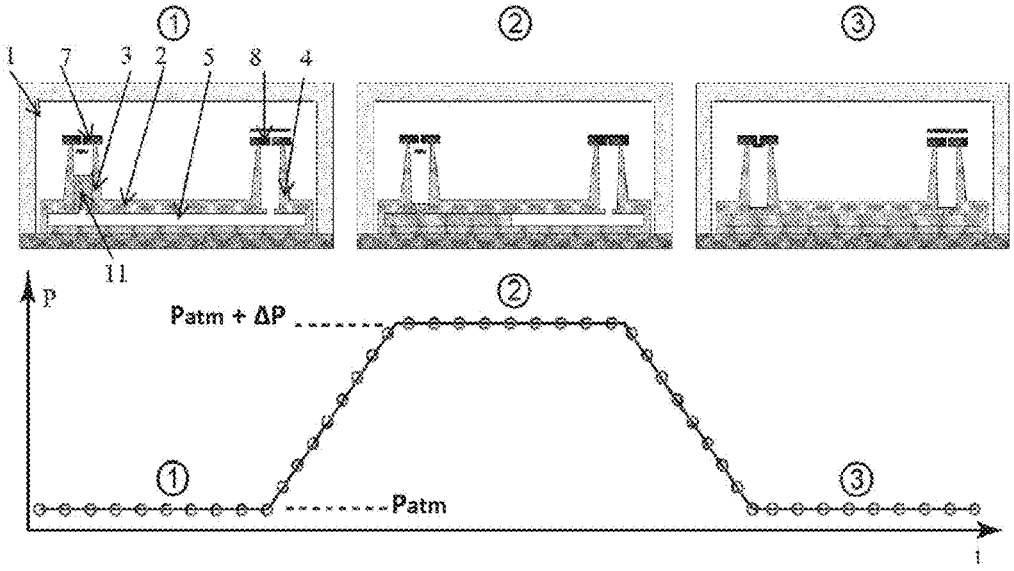
FIG. 18 illustrates a microfluidic device according to the present invention comprising an inward check-valve disposed on the first port and an outward check-valve disposed on the second port; said microfluidic device comprising a solution in the first port and said microfluidic device being disposed in a pressure chamber. Said pressure chamber being first under atmospheric pressure (1), then pressurized (2) and finally under atmospheric pressure (3). The pressure within the pressure chamber is represented by a continuous line while the pressure within the microfluidic device is represented by a series of circles.
Figure 19:
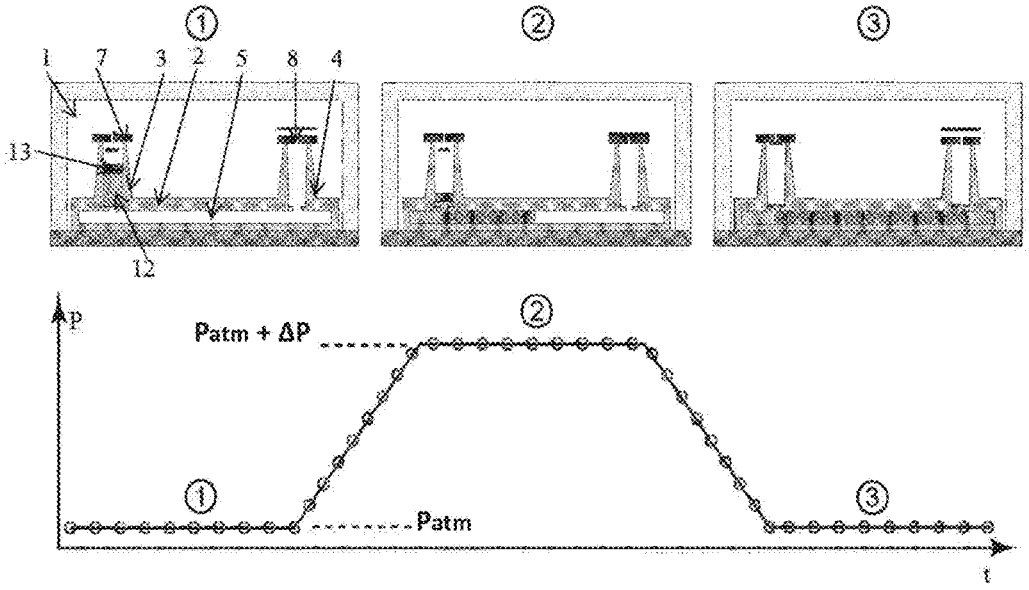
FIG. 19 illustrates a microfluidic device according to the present invention comprising an inward check-valve disposed on the first port and an outward check-valve disposed on the second port; said microfluidic device comprising a carrier fluid and a dispersed phase in the first port; and said microfluidic device being disposed in a pressure chamber. Said pressure chamber being first under atmospheric pressure (1), then pressurized (2) and finally under atmospheric pressure (3). The pressure within the pressure chamber is represented by a continuous line while the pressure within the microfluidic device is represented by a series of circles.
Figure 20:
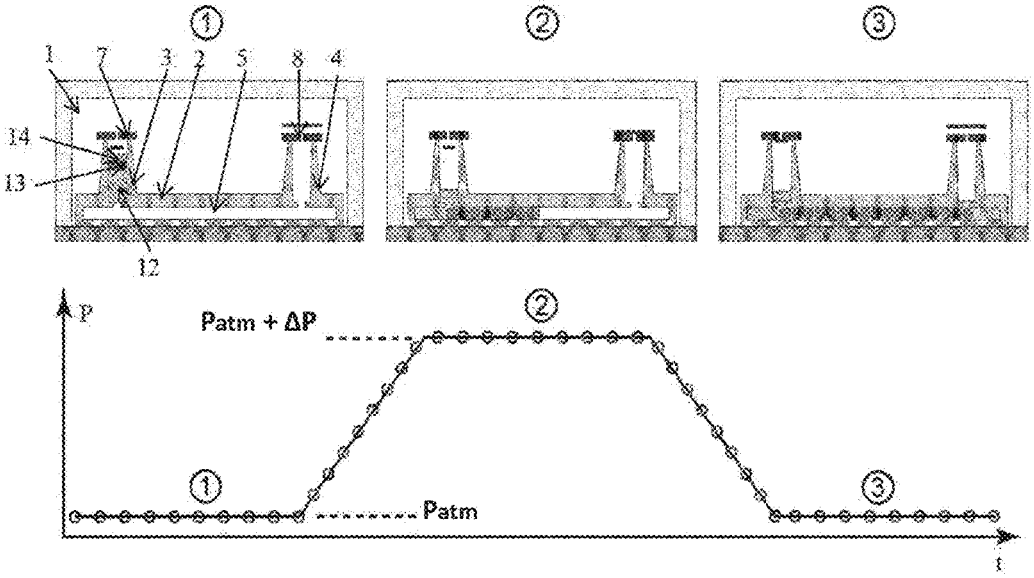
FIG. 20 illustrates a microfluidic device according to the present invention comprising an inward check-valve disposed on the first port and an outward check-valve disposed on the second port; said microfluidic device comprising a carrier fluid, a dispersed phase and a third solution immiscible with the dispersed phase in the first port; and said microfluidic device being disposed in a pressure chamber. Said pressure chamber being first under atmospheric pressure (1), then pressurized (2) and finally under atmospheric pressure (3). The pressure within the pressure chamber is represented by a continuous line while the pressure within the microfluidic device is represented by a series of circles.
Figure 21A:
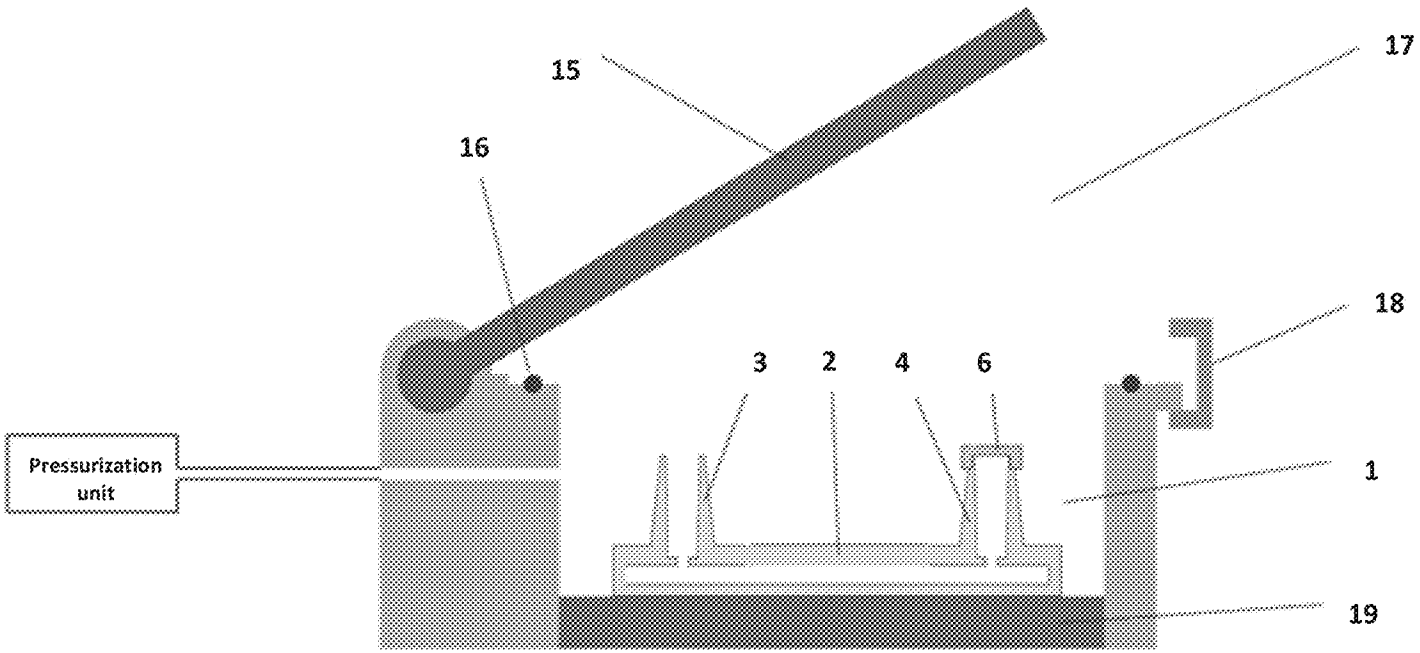
FIG. 21A illustrates the pressure chamber (1) with a movable top lid (15) in the open position and FIG. 21B illustrates the pressure chamber (1) with the movable top lid (15) in the closed position.
Figure 21B:
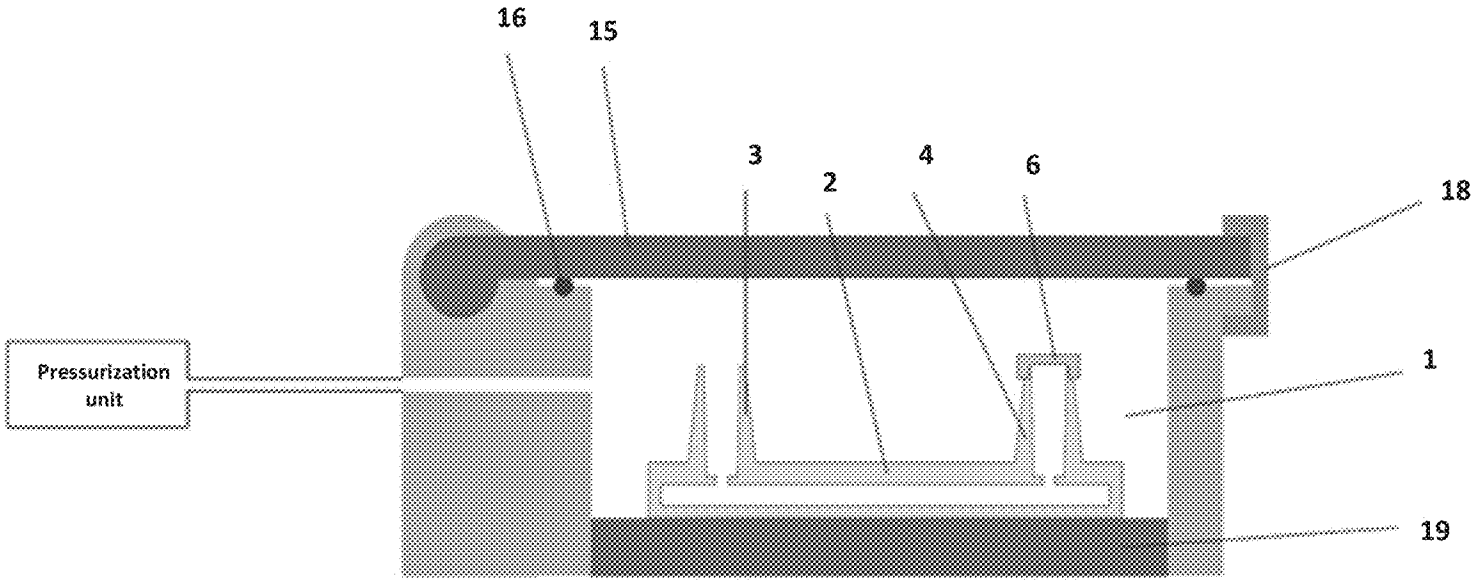

1—Pressure chamber
2—Microfluidic device
3—First port of the microfluidic device
4—Second port of the microfluidic device
5—Microchannel/Network of microchannels of the microfluidic device
6—Stopper
7—Inward check-valve
8—Outward check-valve
9—Flow restrictor
11—Solution
12—Carrier fluid
13—Dispersed phase
14—Third solution
15—Movable top lid
16—Gasket
17—Aperture
18—Clamping mechanism
19—Bottom plate

EXAMPLES

The present invention is further illustrated by the following examples.

Example 1: Priming multiple microfluidic devices with oil using outward check-valves on the output ports of the microfluidic devices.

Material

The pressure chamber consists in a parallelepiped box 18 cm in length, 15 cm in width and 8 cm in height and of inner volume of 1 liter, assembled from an aluminum bottom plate and a milled PMMA casing. An O-ring is placed between the two pieces to provide a gas-tight seal that is able to resist an over-pressure of up to 1 bar applied inside the pressure chamber. The PMMA casing features a PMMA screw lid, 11 cm in diameter, that allows easy opening and closing of the pressure chamber in order to place microfluidic devices to be primed into the pressure chamber. An O-ring is placed between the casing and the screw lid to provide a gas-tight seal.

The pressurization unit consists in a Fluigent MFCS pressure controller with integrated manometer and loop feedback control, connected to a pressure source of 1 bar. The pressurization unit is itself connected to the pressure chamber via silicone tubing through a fluidic port located in the center of the screw lid. The Fluigent MAES Flow software dynamically controls the overpressure applied to the pressure chamber, in real-time or following set pressure commands.

The microfluidic device has an appearance and dimensions similar to that of a microscope slide. It is 36 mm in width, 77 mm in length and 1.5 mm in thickness. It is made by bonding a slab of cyclic olefin polymer (COP) into which are molded networks of microchannels to a thin sheet of COP.

The microfluidic device features 4 identical networks of microchannels, each connecting one first port to one second port. The first and second ports have the dimensions of a standard male Luer connector, as defined by the ISO 594-1 norm. They have a hollow conical structure extending 9 mm from the top surface of the microfluidic device. The outer wall of the connector features a 6% inward taper to meet the Luer ISO 594-1 standard and the inner volume of the port, from the top of the port to its bottom junction with the network of microchannels has an inner volume of 65 μL.

The network of microchannels is described from the first port to the second port. It first features a microchannel of rectangular cross section, 200 μm in width and 150 μm in height, connecting the bottom of the first port to a comb of 33 injection microchannels of smaller dimensions, roughly 52 μm in width and 25 μm in height. These 33 microchannels all lead to a microchamber, spanning 2 of its 4 lateral sides along one of its corner. The microchamber has a width of 22 mm, a length of 15 mm and a height of 120 μm, except on its rim where the floor and roof of the chamber feature a wedge geometry. The wedged rim of the chamber extends 500 μm from the side of the chamber. The height of the chamber on its outer periphery is 25 μm and increases linearly to 65 μm at the inner edge of the wedged rim, where it then abruptly increases to 120 μm. At the corner of the microchamber opposite to the comb of small microchannels, an outlet channel 200 μm in width and 150 μm in height connects the microchamber to the second port of the microfluidic device.

The junction of the injection microchannels to the wedged rim of the microchamber serves as a fluid partitioning zone, as described in Dangla, R., Kayi, S. C., & Baroud, C. N. (2013). *Droplet microfluidics driven by gradients of confinement. Proceedings of the National Academy of Sciences,* 110(3), 853-858 and Baroud, C., & Dangla, R. (2011). U.S. patent application Ser. No. 13/637,779, and familiar to the man skilled in the art. The central region of the microchamber of central height larger that the maximum height of its wedged rim serves as a trapping region for the dispersed phase to be introduced in the microfluidic device.

To obtain the best performances from the fluid partitioning zone and the trapping region of the microfluidic device, the network of microchannels undergoes a surface treatment in order to optimize the fluid affinity of its walls to the carrier fluid and dispersed phases to be introduced into the microfluidic device.

The closing member is a standard female Luer lock to male Luer lock check-valve with a silicone diaphragm obtained from Cole Palmer, Nordson Medical or Smart Products. The direction of flow is from the female Luer to the male Luer side of the lock. One of such Luer check-valve is disposed onto each of the 4 second ports of the microfluidic device, thus configured as an outward check-valve.

Methods

The four microfluidic networks of three microfluidic devices are primed with oil simultaneously using the materials disclosed above and the method described below.

60 μL of oil, such as silicone oil (XIAMETER® PMX-200 SILICONE FLUID 50CS, XIAMETER® PMX-200 SILICONE FLUID 500CS), fluorinated oil (3M Fluorinert FC-40, 3M Fluorinert FC-770, 3M Novec 7100), are pipetted into each of the 4 first ports of each of the 3 microfluidic devices.

The 3 microfluidic devices with oil in the first ports and outward check-valves on the second ports are placed into the pressure chamber at atmospheric pressure. The pressure chamber is closed and sealed by tightening the screw lid.

The pressurization unit then increases the pressure in the pressure chamber to 400 mbar above atmospheric pressure during 6 seconds and maintains the pressure to 400 mbar during 1 minute.

The overpressure in the pressure chamber is directly transmitted to the oil contained in the first ports but is not transmitted to the gas contained in the second ports and the networks of microchannels, which are sealed from the pressure in the pressure chamber by the outward check-valves. As a result, the oil is submitted to a pressure gradient which forces it to flow from the first ports into the networks of microchannels and eventually into the second ports. As it does so, it compresses the gas initially contained into the networks of microchannels and second ports. The flow stops once the pressure of this gas equilibrates with the pressure applied to the pressure chamber.

After 1 minute at 400 mbar, all networks of microchannels are primed with the oil. The pressure is rapidly decreased back to atmospheric pressure. During the pressure decrease, the compressed gas in the second ports exits through the outward check-valves. As a result, there is no pressure difference between the first and second ports, such that there is no back-flow of the oil which remains into the networks of microchannels.

Since all networks of microchannels, second ports and check-valves have identical dimensions, the volume of oil injected is identical for each network of microchannel of each microfluidic device and the priming is reproducible.

The screw lid of the pressure chamber is opened and the primed microfluidic devices are extracted for further treatment.

Example 2: Priming multiple microfluidic devices with oil using stoppers on the output ports of the microfluidic devices.

Materials

The pressure chamber, the pressurization unit and the microfluidic devices are identical to those described in example 1.

The closing member is a standard female Luer or Luer-lock cap from Cole Palmer or Nordson Medical. The female Luer caps are not placed onto the microfluidic device prior to implementing the priming method.

Methods

Similarly to example 1, the four microfluidic networks of three microfluidic devices are primed with oil simultaneously using the materials disclosed above and the method described below.

First, 30 μL of oil is pipetted in each first port and each second port. Female Luer caps are then firmly placed onto each second port to act as stoppers.

The 3 microfluidic devices with oil in all ports and stoppers on the second ports are placed into the pressure chamber at atmospheric pressure. The pressure chamber is closed and sealed by tightening the screw lid.

The pressurization unit then increases the pressure in the pressure chamber to 600 mbar above atmospheric pressure during 6 seconds and maintains the pressure to 600 mbar during 1 minute.

Similarly to example 1, the overpressure in the pressure chamber is directly transmitted to the oil contained in the first ports but is not transmitted to the gas contained in the second ports and the networks of microchannels, which are sealed from the pressure in the pressure chamber by the Luer caps. Oil flows into all networks of microchannels and the flows stop once the pressures equilibrate.

At the end of this first phase, the 20 μL of gas initially contained into the networks of microchannels has been forced to flow into the second ports and is replaced by oil initially placed in the first ports. The gas resides above the 30 μL of heavier oil which partially fills the second port.

The pressure is then decreased to atmospheric pressure over 15 seconds. As the pressure decreases in the pressure chamber, the compressed gas in the second ports pushes the oil to back-flow from the second ports through the networks of microchannels to the first ports. A volume of 20 μL of oil, identical to the volume forced into the network of microchannels during pressurization, flows back to the first ports.

At the end of the procedure, all networks of microchannels are primed with oil, with 30 μL of oil in the first ports and 10 μL in the second ports.

Again, since all networks of microchannels, second ports and check-valves have identical dimensions, the volume of oil injected is identical for each network of microchannel of each microfluidic device and the priming is reproducible.

The screw lid of the pressure chamber is opened and the primed microfluidic devices are extracted for further treatment.

Example 3: Production of arrays of aqueous droplets inside multiple microfluidic primed with oil using outward check-valves on the output ports of the microfluidic devices.

Materials

The pressure chamber, the pressurization unit and the microfluidic devices are identical to those described in example 1.

The microfluidic devices are primed with an oil of choice prior to the production of arrays of droplets, using one of the methods described in the example 1. The oil will serve as a carrier phase and contains a surfactant additive to prevent the coalescence of neighboring drops of the aqueous solution. Consequently, the networks of microchannels of the microfluidic devices are completely filled with the carrier phase prior to the loading of the aqueous dispersed phase. Owing to the simultaneous priming method described in example 1, the levels of oil in the first and second ports of the microfluidic devices are all identical from one network of microchannels to the other.

The closing member is a female Luer check-valve similar to the one described in example 1. Check-valves are disposed on all second ports of all microfluidic devices.

Methods

The four microfluidic networks of three microfluidic devices are loaded with arrays of droplets simultaneously using the materials disclosed above and the method described below.

First, 20 μL of aqueous solution is pipetted in each first port, and the 3 microfluidic devices with aqueous solution in all first ports and check-valves on the second ports are placed into the pressure chamber at atmospheric pressure. The pressure chamber is closed and sealed by tightening the screw lid.

The pressurization unit then slowly increases the pressure in the pressure chamber to 351 mbar above atmospheric pressure during 2 minutes and 54 seconds by steps of +1.5 mbar every second and maintains the pressure to 351 mbar during 3 minutes.

Similarly to example 1, the overpressure in the pressure chamber is directly transmitted to the aqueous mix contained in the first ports but is not transmitted to the gas contained in the second ports which are sealed from the pressure in the pressure chamber by the Luer check-valves. The aqueous mixes slowly flow into all networks of microchannels. The regular increase in pressure provides further control of the injection flow rate, which does not exceed approximately 5 μL/min. Limiting the maximum value of the flow rate is necessary to ensure that the droplets to be produced are monodisperse in volume, as described in Dangla, R., Kayi, S. C., & Baroud, C. N. (2013). *Droplet microfluidics driven by gradients of confinement. Proceedings of the National Academy of Sciences,* 110(3), 853-858.

The aqueous mix first displaces the oil from the distribution microchannel and then penetrates the comb of injection microchannels. As soon as the aqueous mix reaches the junction of an injection microchannel with the wedged rim of the microchamber, the aqueous mix spontaneously partitions into droplets. The wedge propels the newly formed droplets which are collected inside the microchamber.

At the end of the 3 minutes at 351 mbar, the pressures applied to the first ports and in the second ports are equilibrated and the flow of the aqueous dispersed phase has stopped. At this point, approximately 70% of all 4 microchambers of all 3 microfluidic devices are filled with an array of approximately 25 000 droplets of the aqueous dispersed phase.

Last, the pressure is rapidly decreased to atmospheric pressure over 15 seconds. During the pressure decrease, the compressed gas in the second ports exits through the outward check-valves. As a result, there is no pressure difference between the first and second ports, such that there is no back-flow of the oil or of the aqueous droplets which remains in the microchambers of the microfluidic devices.

The screw lid of the pressure chamber is opened and the microfluidic devices filled with arrays of aqueous droplets are extracted to be used for further treatment such as thermal cycling and digital PCR.

Example 4: Production of arrays of aqueous droplets inside multiple microfluidic primed with oil using stoppers on the second ports of the microfluidic devices.

Materials

The pressure chamber, the pressurization unit and the primed microfluidic devices are identical to those described in example 3.

The closing member is a female Luer cap serving as a stopper, similar to the one described in example 2. Female Luer caps are disposed on all second ports of all microfluidic devices prior to the following method.

Methods

The four microfluidic networks of three microfluidic devices are loaded with arrays of droplets simultaneously using the materials disclosed above and the method described below.

First, 20 μL of aqueous solution is pipetted in each first port, and the 3 microfluidic devices with aqueous solution in all first ports and female Luer caps on the second ports are placed into the pressure chamber at atmospheric pressure. The pressure chamber is closed and sealed by tightening the screw lid.

The pressurization unit then slowly increases the pressure in the pressure chamber to 552 mbar above atmospheric pressure during 3 minutes and 4 seconds by steps of +3 mbar every second and maintains the pressure to 552 mbar during 3 minutes.

Similarly to example 2, the overpressure in the pressure chamber is directly transmitted to the aqueous mix contained in the first ports but is not transmitted to the gas contained in the second ports which are sealed from the pressure in the pressure chamber by the female Luer caps which serve as stoppers.

Similarly to example 3, the aqueous mixes flow into all networks of microchannels and are partitioned into droplet arrays which are collected in the microchamber.

At the end of the 3 minutes at 552 mbar, the pressures applied to the first ports and in the second ports are equilibrated and the flow of the aqueous dispersed phase has stopped. At this point, approximately 70% of all 4 microchambers of all 3 microfluidic devices are filled with an array of approximately 25 000 droplets of the aqueous dispersed phase. The bottoms of the second ports are filled with a volume of oil that is equal to the volume of aqueous solution that has filled the networks of microchannels.

Last, the pressure is slowly decreased to atmospheric pressure over 6 minutes and 8 seconds by steps of −1.5 mbar every second. During the pressure decrease, the compressed gas in the second ports forces a back-flow of the oil contained in the bottom of the second ports through the networks of microchannels. During the back-flow, the microchamber serves as a trapping region for the partitioned aqueous phase. Indeed, the wedged rim of the microchamber expels droplets of the aqueous dispersed phase because of surface tension effects.

As a result, during the pressure decrease, only the carrier phase, i.e. the oil, flows back from the second port to the first port through the networks of microchannels and around the array of droplets contained in the microchambers. The arrays of aqueous droplets remain in the microchambers of the microfluidic devices.

The screw lid of the pressure chamber is opened and the microfluidic devices filled with arrays of aqueous droplets are extracted to be used for further treatment such as thermal cycling and digital PCR.

Example 5: Production of arrays of aqueous droplets at a constant flow rate inside multiple microfluidic primed with oil using check-valves on the second ports of the microfluidic devices.

Materials

The pressure chamber, the pressurization unit, the primed microfluidic devices and the closing members are identical to those described in example 3.

Methods

The four microfluidic networks of three microfluidic devices are loaded with arrays of droplets simultaneously by injecting an aqueous solution at a constant flow rate using the materials disclosed above and the method described below.

The method is identical to the one described in example 3 except for the pressure profile applied to the pressure chamber during the pressure increase phase.

Instead of a linear increase in pressure from atmospheric pressure to an overpressure of 351 mbars, the pressure is increased following an exponential profile. The pressure increases following such a profile from 1 bar to 1.351 bar during 2 minutes and 54 seconds.

While the exposed priming method does not directly allow to control in the injection flow rate of the aqueous dispersed phase, the exponential profile is optimal to minimize the flow rate variations throughout the increase of pressure and the injection of the aqueous dispersed phase.

Example 6: Combined priming with oil and production arrays of aqueous droplets inside multiple microfluidic using stoppers on the output ports of the microfluidic devices.

Materials

The pressure chamber, the pressurization unit, the microfluidic devices and the closing members are identical to those described in example 2.

Methods

First, 55 μL of fluorinated oil, which will serve as a carrier fluid, is pipetted in each second port and a female Luer cap is firmly placed on top of each second port.

Second, 15 μL of the same fluorinated oil is pipetted in each first port and 20 μL of an aqueous solution which serves as a dispersed phase is pipetted on top of the 15 μL of fluorinated oil. Because fluorinated oil is denser than the aqueous solution, the aqueous solution remains on top of the carrier fluid.

The 3 microfluidic devices with the fluorinated oil and the aqueous solution in all first ports and female Luer caps on the second ports are placed into the pressure chamber at atmospheric pressure. The pressure chamber is closed and sealed by tightening the screw lid.

The pressurization unit then slowly increases the pressure in the pressure chamber to 350 mbar above atmospheric pressure during 5 minutes and 50 seconds by steps of +1 mbar every second and maintains the pressure to 350 mbar during 3 minutes.

Similarly to example 2, the overpressure in the pressure chamber is directly transmitted to the aqueous mix contained in the first ports but is not transmitted to the gas contained in the second ports which are sealed from the pressure in the pressure chamber by the female Luer caps which serve as stoppers.

As the pressure increases, the fluorinated oil at the bottom of the first port first starts to flow into the network of microchannels, forcing the air contained in the network of microchannels into the closed second port. Once all the oil initially present in the first port has flown into the network of microchannels, the aqueous solution starts to flow into the network of microchannels.

Similarly to example 3, the aqueous dispersed phase is partitioned into arrays of droplets as it reaches the microchambers.

At the end of the 3 minutes at 350 mbar, the pressures applied to the first ports and in the second ports are equilibrated and the flows of the oil and aqueous dispersed phase have stopped. At this point, approximately 70% of all 4 microchambers of all 3 microfluidic devices are filled with an array of approximately 25 000 droplets of the aqueous dispersed phase. The second ports are filled with the initially pipetted fluorinated oil plus the oil that has flown from the first port to the second port during the increase in pressure.

Similarly to example 4, the pressure is then slowly decreased back to atmospheric pressure during 5 minutes and 50 seconds by steps of −1 mbar every 1 second. Although there is a back-flow of oil during the pressure decrease, the microchamber acts as a trapping region for the droplets of aqueous solution and only the carrier fluid flows back from the second port to the first port.

The screw lid of the pressure chamber is opened and the microfluidic devices filled with arrays of aqueous droplets are extracted to be used for further treatment such as thermal cycling and digital PCR.

Example 7: The combined production arrays of aqueous droplets inside multiple microfluidic devices primed with oil using stoppers on the output ports of the microfluidic devices and temperature treatment of the arrays of aqueous droplets for amplification of a DNA template by polymerase chain reaction (PCR).

Materials

The pressurization unit and the primed microfluidic devices are identical to those described in example 4. The closing members are female Luer caps identical to those described in example 2.

The pressure chamber is identical to the one described in example 1. However, the pressure chamber is combined with a heating element to control the temperature of its bottom aluminum plate. The pressure chamber is placed on top of the heat block of a PeqLab peqStar in situ X thermocycler. Thermal contact between the heat block of the thermocycler and the bottom plate of the pressure chamber is optimized by applying a layer of Artic Silver© 5 thermal paste between the heat block and the bottom plate of the pressure chamber.

The aqueous solution is a PCR reaction mixture containing $10^3$ target sequences of pUC18 plasmid, 1 μM forward primer, 1 μM reverse primer and 250 nM of fluorescently-labeled hydrolysis probe. The reaction is assembled using 1 Unit of Taq DNA Polymerase, 200 μM of deoxynucleosides triphosphate and 1× MP buffer (MP biomedicals).

Methods

The four microfluidic networks of three microfluidic devices are primed with oil and loaded with arrays of droplets simultaneously using the materials and the methods described in example 4.

First, 20 μL of fluorinated oil, which will serve as a carrier fluid, is pipetted in each second port and a female Luer cap is firmly placed on top of each second port.

Second, 15 μL of the same fluorinated oil is pipetted in each first port and 20 μL of the aqueous solution described above, which serves as a dispersed phase is pipetted on top of the 15 μL of fluorinated oil. Because fluorinated oil is denser than the aqueous solution, the aqueous solution remains on top of the carrier fluid.

The 3 microfluidic devices with the fluorinated oil and the aqueous solution in all first ports and female Luer caps on the second ports are placed into the pressure chamber at atmospheric pressure onto the bottom plate of the pressure chamber at ambient temperature. The pressure chamber is closed and sealed by tightening the screw lid.

The pressurization unit then slowly increases the pressure in the pressure chamber to 750 mbar above atmospheric pressure during 6 minutes and 15 seconds by steps of +2 mbar every second and the pressure of 750 mbar is maintained in the pressure chamber.

Similarly to example 4, the overpressure in the pressure chamber is directly transmitted to the aqueous mix contained in the first ports but is not transmitted to the gas contained in the second ports which are sealed from the pressure in the pressure chamber by the female Luer caps which serve as stoppers.

As the pressure increases, the fluorinated oil at the bottom of the first port first starts to flow into the network of microchannels. Once all the oil initially present in the first port has flown into the network of microchannels, the aqueous solution starts to flow into the network of microchannels.

Similarly to example 4, the aqueous dispersed phase is partitioned into arrays of droplets as it reaches the microchambers.

At the end of the 6 minutes and 15 of pressure increase, approximately 70% of all 4 microchambers of all 3 microfluidic devices are filled with an array of approximately 25 000 droplets of the aqueous dispersed phase. The second ports are filled with the initially pipetted fluorinated oil plus the oil that has flown from the first port to the second port during the increase in pressure.

Using the peqStar in situ thermocycler and while maintaining the pressure in the pressure chamber at 750 mbar, the temperature of the bottom plate is first increased to 95° C. for 10 minutes. The bottom plate heats the arrays of droplets contained in the microfluidic devices to the same temperature.

Following this initial heating phase, the temperature of the bottom plate then undergoes 40 cycles of cooling at 58° C. for 1 minute and heating at 95° C. for 30 seconds, again while maintaining the pressure in the pressure chamber at 750 mbar. Finally, the temperature of the bottom plate is decreased back to ambient temperature and maintained at this temperature.

This temperature treatment of the bottom plate is transmitted to the arrays of droplets contained in the microchamber of the microfluidic devices. As a result, the droplets that contain at least one copy of the target nucleic acid, called positive droplets, undergo a polymerase chain reaction (PCR) that amplifies the concentration of the target nucleic acid in these positive droplets, detected through an increase in fluorescence intensity of the droplets due to the hydrolysis of the targeted probe. The droplets that do not contain a copy of the target nucleic acid do not undergo PCR amplification, and therefore do not show an increase in fluorescence Similarly to example 4, the pressure is then slowly decreased back to atmospheric pressure during 6 minutes and 15 seconds by steps of −2 mbar every 1 second. Although there is a back-flow of oil during the pressure decrease, the microchamber acts as a trapping region for the droplets of aqueous solution and only the carrier fluid flows back from the second port to the first port.

The screw lid of the pressure chamber is opened and the microfluidic devices filled with arrays of aqueous droplets which have undergone PCR amplification are extracted to be used for further treatment or analysis.

This example has the advantage of combining the production of droplet arrays in multiple microfluidic devices with PCR amplification.

The invention claimed is:

1. A contact-less priming system for loading a solution in a microfluidic device comprising:

at least one microfluidic device comprising at least one first port, at least one closed second port and at least one microchannel, wherein each of said at least one first and second ports are fluidly connected to said at least one microchannel and wherein said at least one first port is suitable for containing at least one solution;

a pressure chamber with at least one closable, gas tight aperture, configured to enclose said at least one microfluidic device; and a pressurization unit fluidly connected to the pressure chamber for applying pressure in the pressure chamber and upon the at least one first port.

2. The contact-less priming system according to claim 1, wherein the at least one first port has a capacity ranging from 1 to 1000 microliters.

3. The contact-less priming system according to claim 1, wherein the pressurization unit comprises a pressure source, a pressure monitoring device and a feedback control to pressurize the pressure chamber at a pressure suitable to cause a selected amount of the at least one solution to pass from the at least one first port to the at least one microchannel.

4. The contact-less priming system according to claim 1, further comprising at least one closing member disposed on the at least one first port, configured to close at least partially and/or to open at least partially said at least one first port.

5. The contact-less priming system according to claim 1, wherein the at least one closing member is selected from at least one flow restrictor or at least one check-valve.

6. The contact-less priming system according to claim 1, further comprising at least one filter disposed on the at least one first port inhibiting liquid flow and permeable to gas.

7. The contact-less priming system according to claim 1, wherein the at least one microchannel is filled with a carrier fluid.

8. The contact-less priming system according to claim 1, wherein the at least one microchannel comprises at least one network of microchannels.

9. The contact-less priming system according to claim 8, wherein the at least one network of microchannels comprises at least one microchannel and one fluid partitioning zone.

10. The contact-less priming system according to claim 9, wherein the at least one network of microchannels further comprises at least one region for trapping at least one dispersed phase.

11. A contact-less priming method for loading a solution in a microfluidic device comprising the following steps:

providing at least one microfluidic device comprising at least one first port, at least one closed second port and at least one microchannel, wherein each of said at least one first and second ports are fluidly connected to said at least one microchannel and wherein the at least one first port is suitable for containing at least one solution;

loading at least one solution in the at least one first port;

introducing and enclosing said at least one microfluidic device with the at least one solution in a pressure chamber through at least one closable, gas tight aperture of said pressure chamber under atmospheric pressure; and pressurizing the pressure chamber.

12. The contact-less priming method according to claim 11, wherein at least one closing member is disposed on the at least one first port, configured to close at least partially and/or to open at least partially said at least one first port.

13. The contact-less priming method according to claim 11, wherein the at least one closing member is selected from at least one flow restrictor or at least one check-valve.

14. The contact-less priming method according to claim 11, wherein the at least one microchannel is filled with a carrier fluid.

15. The contact-less priming method according to claim 11, wherein the at least one microchannel comprises at least one network of microchannels, one fluid partitioning zone and at least one region for trapping at least one dispersed phase.

* * * * *